US007699420B2

(12) United States Patent
Date et al.

(10) Patent No.: US 7,699,420 B2
(45) Date of Patent: Apr. 20, 2010

(54) VOLTAGE CONTROL DEVICE, VOLTAGE CONTROL METHOD, AND LIQUID INJECTION DEVICE

(75) Inventors: Masakazu Date, Hachioji (JP); Hiroaki Arakawa, Uenohara (JP)

(73) Assignee: Konica Minolta Holdings, Inc., Tokyo (JP)

( * ) Notice: Subject to any disclaimer, the term of this patent is extended or adjusted under 35 U.S.C. 154(b) by 592 days.

(21) Appl. No.: 11/725,806

(22) Filed: Mar. 20, 2007

(65) Prior Publication Data

US 2007/0229560 A1 Oct. 4, 2007

(30) Foreign Application Priority Data

Mar. 29, 2006 (JP) ..... 2006-091385
Mar. 29, 2006 (JP) ..... 2006-091386
Jul. 14, 2006 (JP) ..... 2006-193693

(51) Int. Cl.
*B41J 29/38* (2006.01)
*B41J 29/393* (2006.01)

(52) U.S. Cl. ..... 347/10; 347/14; 347/19

(58) Field of Classification Search ..... 347/10, 347/14, 19

See application file for complete search history.

(56) References Cited

U.S. PATENT DOCUMENTS

2006/0077404 A1* 4/2006 Usui ..... 358/1.2

FOREIGN PATENT DOCUMENTS

JP 11-58735 A 3/1999
JP 2006-95864 A 4/2006

* cited by examiner

*Primary Examiner*—Julian D Huffman
(74) *Attorney, Agent, or Firm*—Frishauf, Holtz, Goodman & Chick, P.C.

(57) ABSTRACT

A voltage control device for a liquid injection head corrects a voltage supplied to the liquid injection head.

16 Claims, 19 Drawing Sheets

VOLTAGE CONTROL DEVICE, VOLTAGE CONTROL METHOD, AND LIQUID INJECTION DEVICE

TECHNICAL FIELD

The present invention relates to a voltage control device of a liquid injection head, a voltage control method and a liquid injection device of a liquid injection head, and in particular to a voltage control device of a liquid injection head wherein voltage for driving a liquid injection head is read to calculate a correction value, and voltage is controlled accurately, and to a voltage control method and a liquid injection device of a liquid injection head.

BACKGROUND

As an liquid injection device having a liquid injection head capable of jetting a liquid under the state of microscopic liquid droplets, an image recording apparatus such as an inkjet printer that records images on a recording sheet, for example, is equipped with a liquid injection head having plural recording heads which jet ink droplets, and thereby, it is capable of printing images processed by a computer under the multicolor and multicontrast conditions, and is in widespread use as an output device for the computer.

For this recording head, piezoelectric elements are used as drive elements for jetting ink droplets, and when a plurality of piezoelectric elements provided corresponding to plural nozzles are driven selectively, ink droplets are jetted from the nozzles based on dynamic pressure of each piezoelectric element to stick to a recording sheet, thus a dot is formed, and intended printing is carried out. In recent years, the number of recording heads to be used for the image recording apparatus of this kind has been increased, for improving print resolution and a recording speed.

In this case, each piezoelectric element is driven based on the drive waveform in a prescribed form amplified up to the prescribed voltage, so that an ink droplet may be jetted from each nozzle in a necessary amount of ink droplet. Therefore, it is necessary to drive the piezoelectric element accurately at a prescribed voltage, for recording superior images with high image quality. However, since the piezoelectric element has generally fluctuations caused by differences of physical properties and processes, a different recording head, or a different nozzle even of the same recording head, needs voltage which is required for the different recording head or for the different nozzle. Further, different physical properties (viscosity and surface tension or the like) of a liquid such as jetted ink need different voltages.

Therefore, in the conventional voltage control device controlling drive of a recording head (for example, the voltage control device described in Japanese Patent Publication Open to Public Inspection No. 11-58735), it is possible to conduct calibration wherein voltage after the drive waveform to be applied on a recording head is amplified up to prescribed voltage is read, and the voltage is judged whether it is amplified accurately up to the prescribed voltage or not, and when it is not amplified to the prescribed voltage, a correction value for correcting its difference is calculated, and voltage based on the correction value is established newly, so that the piezoelectric element may be driven accurately at the prescribed voltage, and it has the structure shown in FIG. 9.

In FIG. 9, the numeral 100 represents a voltage controller, and voltage established by this voltage controller 100 is boosted by voltage amplifying sections 101 and 101 on the rear step to the prescribed voltage. Voltages boosted by the voltage amplifying sections 101 and 101 are sent to waveform amplifying sections 103 and 103 where the prescribed drive waveform generated in waveform generating section 102 is amplified to the voltage boosted by voltage amplifying sections 101 and 101 to be applied on each recording head 104, thus, a piezoelectric element of each recording head 104 is driven to jet ink droplet.

When voltage adjustment is conducted in this case, voltage immediately after being boosted by voltage amplifying sections 101 and 101 is read by voltage reading section 105 composed of AD converter, and is compared with the voltage established in advance, in voltage controller 100. As a result, when a difference from the voltage established in advance is caused, a correction value to correct the difference is calculated, and is stored in correction value storing section 100*a* in the voltage controller 100. Then, in the case of driving, the new voltage based on the correction value is established as correction voltage.

In the conventional voltage control device, the voltage immediately after being boosted by each of the voltage amplifying sections 101 and 101 is read, and voltage supplied to recording heads 104 and 104 is controlled based on the results of reading the aforesaid voltage.

However, the read step where voltage is read by voltage reading section 105 as stated above, is provided with waveform amplifying sections 103 and 103 for generating drive signals applied actually on recording heads 104 and 104, thus, a portion of fluctuation by amplification in this case is not considered in the voltage read by voltage reading section 105. Therefore, the voltage read by the voltage reading section 105 is one different from voltage applied on recording heads 104 and 104 actually through waveform amplifying sections 103 and 103.

Accordingly, even if the voltage adjustment is carried out based on the voltage acquired through reading by voltage reading section 105, correction is made under the reference of voltage that is different from voltage applied actually on each of recording heads 104 and 104, which makes it impossible to establish correct voltage, and causes dispersion in jetting ink droplets, resulting in a cause to decline image quality.

Therefore, when controlling voltage of recording heads 104 and 104, it is desired to conduct voltage adjustment by reading voltage immediately before applying on recording heads 104 and 104. However, for reading the voltage immediately before applying on recording heads 104 and 104, it is required to read voltage of drive waveform in a complicated form combined with a drive waveform generated in waveform generating section 102, which has caused a problem that the structure for reading voltage is complicated.

For example, in the case of a liquid injection head of a shear mode type wherein a side wall of a channel for reserving a liquid is formed with piezoelectric elements, and the side wall is deformed to the doglegged shear to give pressure for jetting a liquid in the channel, a rectangular drive waveform light that shown in FIG. 4(*a*) is sometimes used. In the case of the drive signals acquired by amplifying the aforesaid drive waveform up to the prescribed voltage, a period of time t for maintaining the maximum voltage Vmax is only about 2 μs, which makes it difficult to read voltage value accurately in such a short time, and requires a high speed reading device, resulting in a problem of a factor of cost increase.

There is further available a method to read the voltage before conducting waveform amplification by combining drive waveform and voltage. However, in the voltage which is read out by the aforesaid method, an amount equivalent to waveform amplification fluctuations after combining with drive waveform is not considered, and therefore, even when voltage correction is made based on the voltage thus read out, the correction is made under the reference of voltage which is different from voltage which is actually applied on a liquid injection head and has an amount equivalent to waveform amplification fluctuations, whereby, correct voltage cannot be set.

On the other hand, in the case of an image recording apparatus having a plurality of liquid injection heads, it is desired that voltage correction is conducted by distinguishing those requiring voltage correction from those requiring no voltage correction easily, because each of liquid injection heads needs to be corrected in terms of voltage individually. The problem of this kind is the same for the occasion where each of plural nozzles of a liquid injection head needs to be corrected in terms of voltage individually.

Japanese Patent Publication Open to Public Inspection No. 2006-95864 discloses a technology wherein signals for adjustment other than signals for jetting are used to solve characteristics dispersion in plural drive signal generating sections such as that for forming large dots, that for forming medium dots and that for forming small dots. However, there is no disclosure for a technology to conduct voltage correction individually for plural liquid injection heads or for plural nozzles.

Further, when obtaining a correction value from the voltage thus read out, it is desired that an accurate correction value having no dispersion is calculated.

With the aforesaid background, problems of the invention is to provide a voltage control device of a liquid injection head, a voltage control method and a liquid injection device of a liquid injection head, wherein voltage including an amount of amplification amplified in terms of waveform under the state immediately before being applied on a liquid injection head can be measured by a simple structure, thereby, voltage can be controlled accurately, accurate correction value having no dispersion can be calculated, and reliability of voltage control is high.

SUMMARY

It is therefore an object of the present invention to provide a voltage control device for a liquid injection head including: a waveform generator for setting drive waveform to be applied on the liquid injection head that injects a liquid from a nozzle by changing a drive voltage; a voltage determining device that determines voltage of the drive waveform set by the waveform generator; a voltage amplifier that boosts a voltage to be applied on the liquid injection head so as to be the voltage determined by the voltage determining device; a waveform amplifier that amplifies a drive waveform set by the waveform generator so that the voltage of the drive waveform is the voltage boosted by the voltage amplifier; a voltage reader that reads the voltage of the drive waveform amplified by the waveform amplifier; and a voltage adjuster that compares the voltage read by the voltage reader with voltage determined by the voltage determining device, calculates a correction value from a result of the comparison, and adds correction to the voltage determined by the voltage determining device based on the correction value, wherein the waveform generator comprising the first drive waveform generator that outputs the first drive waveform for the liquid injection, and the second drive waveform generator that outputs the second drive waveform for the voltage correction, and a switch that switches the drive waveform from the waveform generator to either one of the first drive waveform and the second drive waveform.

DESCRIPTION OF THE PREFERRED EMBODIMENT

Figure 1:
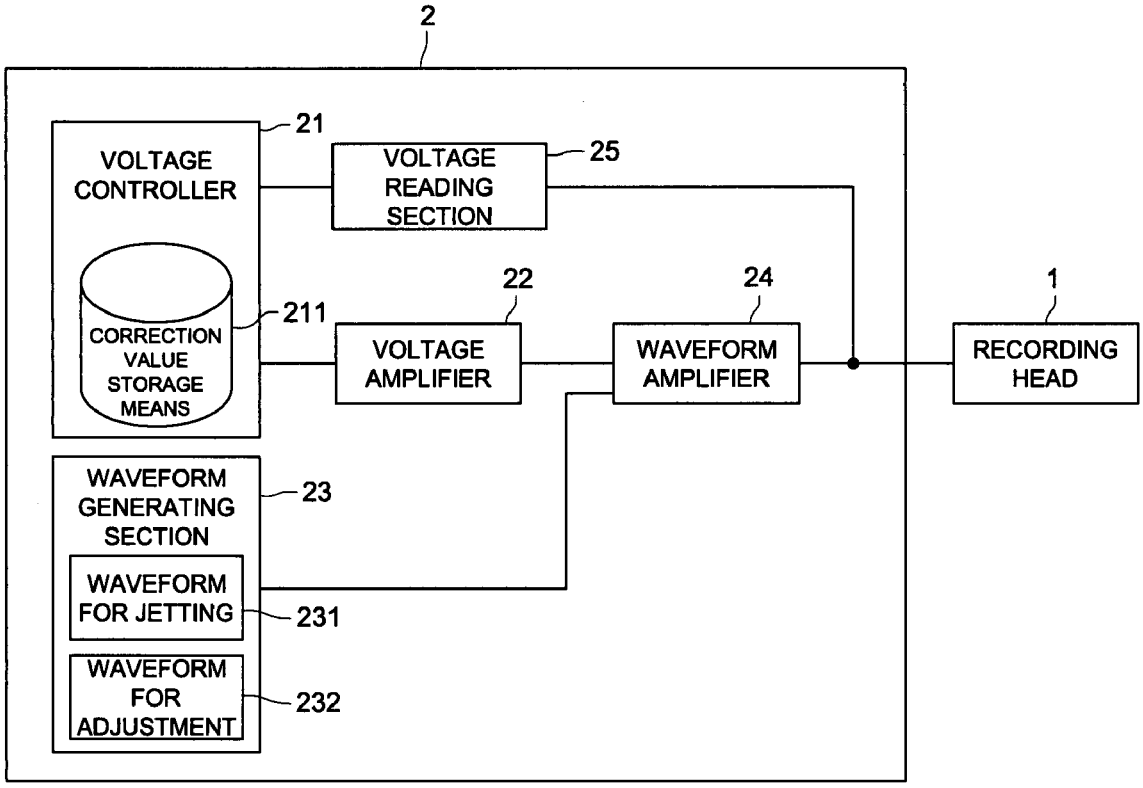
FIG. 1 is a block diagram showing an example of a liquid injection device relating to the first embodiment of the present invention.

One aspect of the invention is a voltage control device of a liquid injection head having therein a waveform generating means for setting drive waveform to be applied on a liquid injection head that injects a liquid from a nozzle through driving by changing voltage, a voltage determining means that determines voltage of drive waveform established by the waveform generating means, a voltage amplifying means that boosts voltage to be applied on the liquid injection head so that the voltage may come to the voltage determined by the aforesaid voltage determining means, a waveform amplifying means that amplifies a drive waveform established by the waveform generating means so that it mat come to voltage boosted by the voltage amplifying means, a voltage reading means that reads out voltage immediately after being amplified by the waveform amplifying means and a voltage adjusting means that compares the voltage read out by the voltage reading means with voltage determined by the voltage determining means, then, calculates a correction value from a result of the comparison, and adds correction to the voltage determined by the voltage determining means based on the correction value wherein the waveform generating means has the first drive waveform generating means that outputs the first drive waveform used in ordinary liquid injection, and the second drive waveform generating means that outputs the second drive waveform used in the course of voltage correction, and a switching means that switches drive waveform coming from the waveform generating means to either one of the first drive waveform and the second drive waveform.

One aspect of the invention is a voltage control device of a liquid injection head described in Item 2 wherein the aforesaid selecting means is a maximum value selecting means that selects only the maximum voltage from the aforesaid respective voltages, and the aforesaid voltage determining means determines voltage lower than drive waveform to be corrected in terms of voltage, for the drive waveform other than those to be corrected in terms of voltage, among second drive waveforms corresponding respectively to the aforesaid plural liquid injection heads or the aforesaid plural nozzles, in the case of voltage correction.

One aspect of the invention is a voltage control device of a liquid injection head described in Item 3 wherein the maximum value selecting means is of the structure wherein plural signal wires which read respectively voltages after being amplified by the aforesaid plural waveform amplifying means are connected through wired OR connection, and are outputted to the aforesaid voltage reading means by a single signal wire.

One aspect of the invention is the voltage control device of a liquid injection head, wherein the aforesaid maximum value selecting means is composed of a diode array.

One aspect of the invention is the voltage control device of a liquid injection head, wherein the aforesaid second drive waveform is a direct current waveform.

One aspect of the invention is the voltage control device of a liquid injection head having therein D/A converter for establishing a voltage value of waveform to be applied on a liquid injection head that injects a liquid from a nozzle by changing voltage and driving, waveform for jetting generating means to generate waveform for jetting that jets a liquid normally at voltage relating to the voltage established by the D/A converter, waveform for adjustment generating means that generates waveform for adjustment having a portion of voltage equal to voltage relating to the voltage established by the D/A converter, a switching means that switches the waveform to be outputted to the liquid injection head to either one of the aforesaid two types of waveforms, reference voltage generating means that generates reference voltage, a comparing means that reads out voltage of waveform outputted from the switching means, and compares with the reference voltage generated by the reference voltage generating means and calculation control means that controls the D/A converter and the switching means, and adjusts, based on the results of the comparison by the comparing means, the voltage value to be established in the D/A converter, wherein the aforesaid calculation control means causes the waveform for adjustment to be inputted in the comparing means by controlling the switching means in the course of voltage adjustment, and adjusts a voltage value to be set in the A/D converter based on the results of comparison with the reference voltage in the comparing means.

One aspect of the invention is a voltage control device of a liquid injection head having therein a D/A converter for establishing a voltage value of waveform to be applied on a liquid injection head that injects a liquid from a nozzle by changing voltage and driving, waveform for jetting generating means to generate waveform for jetting that jets a liquid normally at voltage relating to the voltage established by the D/A converter, waveform for adjustment generating means that generates waveform for adjustment having a portion of voltage equal to voltage relating to the voltage established by the D/A converter, a switching means that switches the waveform to be outputted to the liquid injection head to either one of the aforesaid two types of waveforms, reference voltage generating means that generates reference voltage, a selecting means that selects and outputs reading of either one of voltage of waveform outputted from the switching means and reference voltage outputted from the reference generating means, a voltage divider that divides voltage of waveform outputted from the selecting means, an A/D converter that conducts A/D conversion on voltage divided by the voltage divider and outputs, and a calculation control means that controls the D/A converter, the switching means and the selecting means, and adjusts, based on the output from the A/D converter, the voltage value to be established in the D/A converter, wherein the calculation control means adjusts a voltage value to be established on the D/A converter in the case of adjusting voltage based on the value resulting from voltage of the waveform for adjustment subjected to A/D conversion by the A/D converter by controlling the switching means and the selecting means and the value resulting from the reference voltage subjected to A/D conversion by the A/D converter by controlling the selecting means.

One aspect of the invention is a voltage control device of a liquid injection head having therein a D/A converter for establishing a voltage value of waveform to be applied on a liquid injection head that injects a liquid from a nozzle by changing voltage and driving, a waveform for jetting generating means to generate waveform for jetting that jets a liquid normally at voltage relating to the voltage established by the D/A converter, a waveform for adjustment generating means that generates waveform for adjustment having a portion of voltage equal to voltage relating to the voltage established by the D/A converter, the first switching means that switches the waveform to be outputted to the liquid injection head to either one of the aforesaid two types of waveforms, a reference voltage generating means that generates reference voltage, a voltage divider that reads out voltage of waveform outputted from the first switching means and divides, the second switching means that switches to either one of voltage divided by the voltage divider and reference voltage generated by the reference voltage generating means and outputs, an A/D converter that conducts A/D conversion on voltage outputted from the second switching means and a calculation control means that controls the D/A converter, the first switching means and the second switching means, and adjusts a voltage value to be established on the D/A converter based on output coming from the A/D converter, wherein the calculation control means adjusts, in the case of adjusting voltage, a voltage value to be established on the D/A converter, based on the value acquired by A/D-converting voltage of the waveform for adjustment with the A/D converter by controlling the first and second switching means, and the value acquired by A/D-converting the reference voltage with the A/D converter by controlling the second switching means.

One aspect of the invention is the voltage control device of a liquid injection head, wherein the reference voltage generated by the reference voltage generating means is generated by dividing a reference voltage supplied to the A/D converter.

One aspect of the invention is the voltage control device of a liquid injection head, wherein the selecting means is a maximum value selecting means that selects only the maximum voltage among the aforesaid respective voltages to be inputted, and the calculation control means establishes, when adjusting voltage, a voltage value that is lower than the waveform for adjustment to be adjusted in terms of voltage, for the waveform for adjustment other than those to be adjusted in terms of voltage among the aforesaid respective waveforms for adjustment corresponding respectively to the aforesaid plural liquid injection heads or the aforesaid plural nozzles.

One aspect of the invention is a voltage control device of a liquid injection head having therein a waveform generating means that generates and outputs drive waveforms to be applied on plural liquid injection heads injecting liquids from nozzles by changing voltage to drive, or to be applied on plural nozzles of a liquid injection head injecting liquids from nozzles by changing voltage to drive, a voltage determining means that determines voltage of drive waveform generated by the waveform generating means, a plurality of voltage amplifying means that boost voltage to be applied on the plural liquid injection heads or on the plural nozzles so that the voltage may come to the voltage determined by the aforesaid voltage determining means, a plurality of waveform amplifying means that combine drive waveform outputted from the waveform generating means and voltage outputted from the plural voltage amplifying means, and output them to the liquid injection heads or the plural nozzles, a selecting means that selects voltage to be corrected in terms of voltage among respective voltages immediately after being outputted from the plural waveform amplifying means, a reading means to read out voltage selected by the selecting means, and a voltage adjusting means that compares voltage read out by the reading means with voltage determined by the voltage determining means, then, calculates a correction value from results of the comparison, and gives correction to voltage determined in the voltage determining means based on the correction value, wherein the waveform generating means has the first drive waveform generating means that generates the first drive waveform used in an ordinary liquid injection, the second drive waveform generating means that generates the second drive waveform used in the case of voltage correction and the third drive waveform generating means that is used in the case of voltage correction and has an amplitude value smaller than that of the second drive waveform, and there are provided a switching means that switches a drive waveform outputted from the waveform generating means to any one of the first drive waveform, the second drive waveform and the third drive waveform and a control means that controls the switching means so that the second drive waveform may be outputted from the waveform generating means for those to be corrected in terms of voltage among the aforesaid plural liquid injection heads or the aforesaid plural nozzles, and the third drive waveform may be outputted from the waveform generating means for those not to be corrected in terms of voltage, in the case of voltage correction.

One aspect of the invention is the voltage control device of a liquid injection head, wherein the selecting means is a maximum value selecting means that selects only the maximum voltage among respective voltages outputted from the aforesaid plural waveform amplifying means.

Hereinafter, the preferred embodiments of the present invention will be explained in detail with reference to the accompanying drawings. However, the scope of the invention is not limited to the illustrations. Further, although limited expressions may be used, the scope of the invention is not limited to them.

FIG. 1 is a block diagram showing an example of a liquid injection device used for an image recording apparatus such as an inkjet printer or the like, and the first embodiment of the invention is shown in FIG. 1. In the figure, the numeral 1 represents a recording head and 2 represents a voltage control device that controls voltage for recording head 1.

Figure 2:
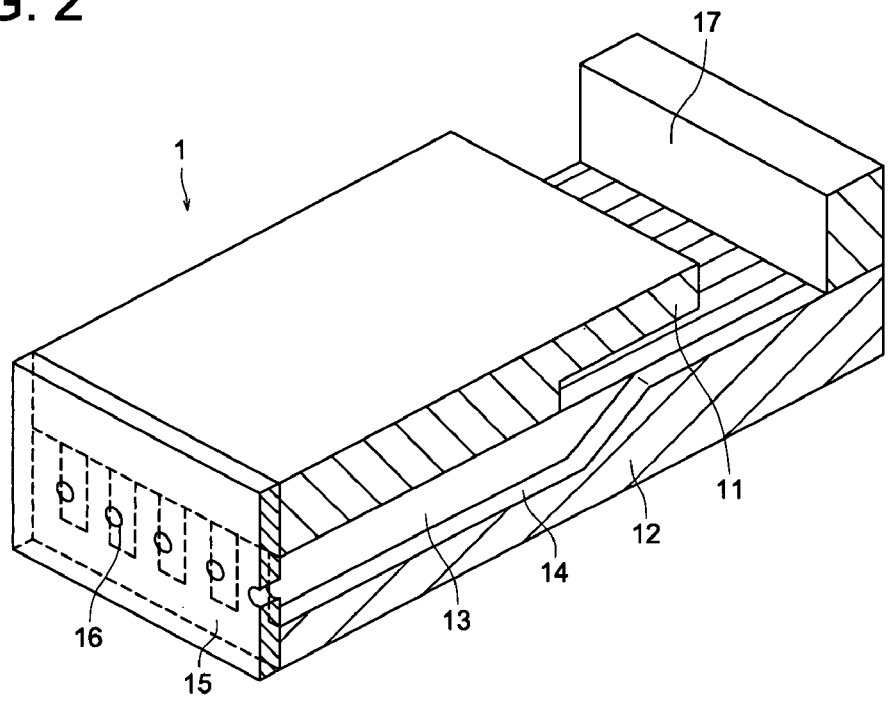
FIG. 2 is a perspective view showing, with a partial sectional view, a schematic structure of a recording head of a shear mode type.

Recording head 1 is a liquid injection head having the structure for injecting a liquid from a nozzle by driving it by means of changing voltage, and what is shown in FIG. 2 is given as its example.

Figure 3:
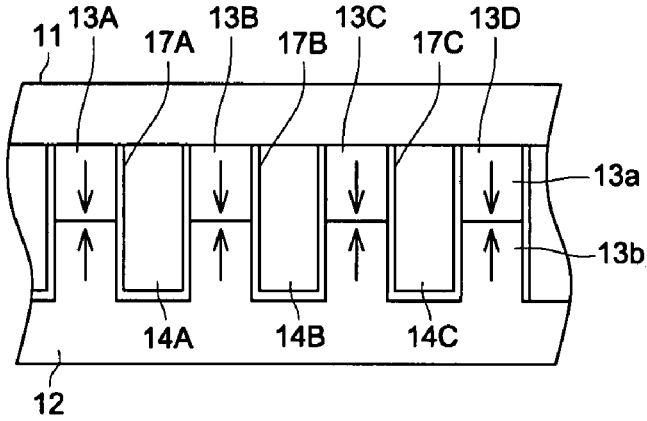
FIGS. 3(*a*), (*b*), and (*c*) diagrams showing operations of the recording head.
Figure 3:
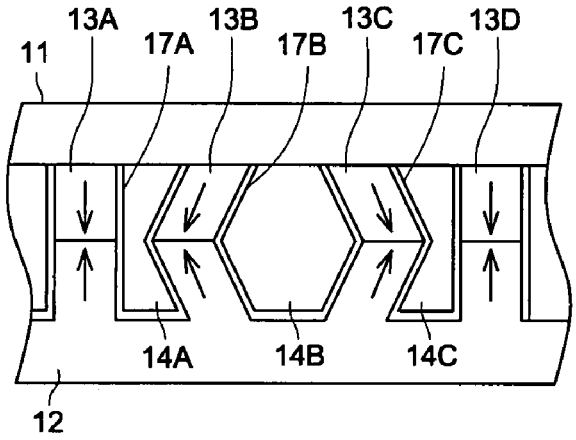
Figure 3:
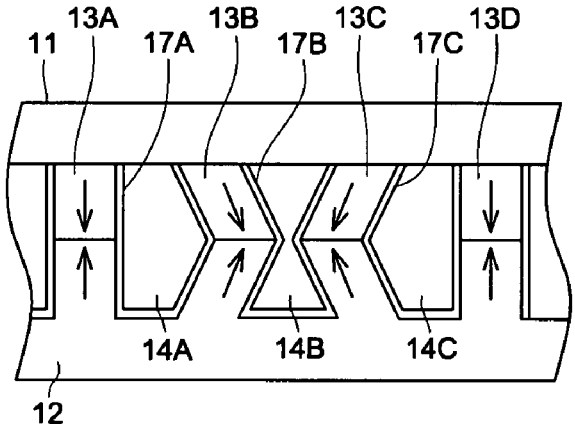

FIG. 2 is a perspective view showing, with a partial sectional view, a schematic structure of a recording head of a shear mode type, and FIG. 3 is a diagram showing operations of the recording head.

In the recording head 1, a plurality of channels 14 separated by plural side-walls each being composed of piezoelectric elements such as PZT are provided in parallel. In FIG. 3, three channels (14A, 14B and 14C) representing a part of many channels 14 are shown, and the number of channels is not restricted.

One end of channel 14 is connected to nozzle 16 formed on nozzle forming member 15, while, the other end is connected to an unillustrated ink tank through ink supply port 17. On the surface of side-wall 13 in each channel 14, there is formed electrode 17 that is running from the upper part of both side-walls 13 to the bottom surface of channel 14, on a contact basis, and each electrode 17 is connected to voltage control device 2.

Each side-wall 13 is composed of two piezoelectric elements 13*a* and 13*b* each being different in terms of polarization direction as shown with arrows in FIG. 3, and the piezoelectric element may be only a portion having a symbol of 13*a*, and it has only to be on a part of the side-wall 13.

When a prescribed drive signal is applied on electrode 17 formed on the surface of side-wall 13 on a close contact basis, through the control of voltage control device 2, an ink droplet is jetted from nozzle 16 by the operation illustrated below. Incidentally, the nozzle is omitted in FIG. 3.

First, as shown in FIG. 3(*a*), when a drive signal is applied on none of electrodes 17A, 17B and 17C, none of side-walls 13A, 13B, 13C and 13D is deformed. However, when electrodes 17A and 17C are grounded, and a drive signal wherein voltage is changed by a waveform in a shape shown in FIG. 4(*a*), for example, is applied on electrode 17B, voltage of prescribed level is applied on electrode 17B, and thereby, an electric field in the direction perpendicular to the polarization direction of a piezoelectric element constituting side-walls 13B and 13C is generated, whereby, shear deformations are generated on joint surfaces of respective side-walls 13B and 13C and piezoelectric elements 13*a* and 13*b*, and side-walls 13B and 13C are deformed toward outside each other as shown in FIG. 3(*b*), and a volume of channel 14B is enlarged. Due to this, negative pressure is generated in channel 14B to let ink flow in (Draw).

When voltage of drive signal is returned to 0 after continuing the aforesaid state for a certain period of time, side-walls 13B and 13C are returned to neutral positions shown in FIG. 3(*a*) from an enlargement position shown in FIG. 3(*b*), and high pressure is applied on ink in channel 14B (Release). Then, as shown in FIG. 3(*c*), if a volume of channel B is reduced (Reinforce) by applying drive signals so that side-walls 13B and 13C may be deformed in opposite directions each other, positive pressure is generated in channel 14B. Due to this, a meniscus in a nozzle formed by a part of ink filling channel 14B is changed to the direction to be pressed out of a nozzle, and an ink column is jetted from a nozzle. Other respective channels also operate in the same way as in the foregoing by application of drive signals. The drive method of this kind is called a DRR drive method, which is a typical drive method of recording head 1 of a shear mode type jetting an ink droplet from nozzle 16 by changing voltage.

Voltage control device 2 of this kind controlling voltage for driving recording head 1 has therein voltage control section 21, voltage amplifying section 22, waveform generating section 23, waveform amplifying section 24 and voltage reading section 25.

The voltage control section 21 is provided with a voltage determining function that determines voltage level so that desired voltage may be applied on recording head 1, a correction value calculating function that calculates a correction value from voltage read out by the voltage reading section 25 and a voltage adjusting function that corrects voltage determined by the voltage determining function with a correction value calculated by the correction value calculating function, and it is composed of CPU. On this voltage control section 21, there is provided correction value storing means 211, so that the correction value calculated by the correction value calculating function may be stored.

The voltage determining function of the voltage control section 21 determines the maximum voltage level of drive signal to be applied on recording head 1 and controls outputting of the determined maximum voltage level to the voltage amplifying section 22. The correction value calculating function compares the voltage value read out by voltage reading section 25 with the voltage value that is determined by the control function and outputted to the voltage amplifying section 22, and obtains, from a difference resulting from the comparison, a correction rate with which the desired voltage is applied on recording head 1, to conduct the control to store the aforesaid value in the correction value storing means 211 as a correction value. Further, the voltage adjusting function multiplies the correction rate calculated by the voltage determined by the voltage determining function, and conducts control for setting new correction voltage.

The voltage amplifying section 22 amplifies drive voltage to be applied on recording head 1 with a prescribed amplification rate, and is composed of an unillustrated D/A converter 221 that boosts up to the maximum voltage level that is determined in the voltage control section 21 and is needed in recording head 1 and of amplifier 222 such as an OP amplifier. The drive voltage boosted in this case is outputted to waveform amplifying section 24.

The waveform generating section 23 generates a shape of a waveform to be applied on recording head 1 and outputs it to waveform amplifying section 24. In this waveform generating section 23, waveforms in plural types of forms can be generated, and in this case, there are generated waveforms in at least two types of forms including waveform for jetting 231 (first drive waveform) to be used for jetting ink droplets in a waveform composed of a rectangular wave shown, for example, in FIG. 4(*a*) and waveform for adjustment 232 (second drive waveform) to be used in the case of conducting voltage correction for the form of waveform composed of a direct-current waveform shown in FIG. 4(*b*).

In particular, in the invention, if the waveform for adjustment 232 is in a direct-current waveform shown in FIG. 4(*b*), voltage at a fixed level can be kept constantly, and thereby, the structure for amplification in waveform amplifying section 24 in later step and for reading in voltage reading section 25 turns out to be simple, which is preferable.

Further, the waveform generating section 23 is provided with a switching means that switches the waveform to be outputted actually to waveform amplifying section 24 to either one of waveform for jetting 231 and waveform for adjustment 232 both generated in the waveform generating section 23, and the waveform selected from the waveform for jetting 231 and waveform for adjustment 232 is outputted to waveform amplifying section 24. This switching means has only to switch the drive waveform outputted from waveform generating section 23 and inputted in waveform amplifying section 24 to either one of waveform for jetting 231 and waveform for adjustment 232, and the switching means is not always limited to the structure provided on the waveform generating section 23.

The waveform amplifying section 24 inputs drive voltage boosted in voltage amplifying section 22 and drive waveform selected in the waveform generating section 23, and amplifies the inputted drive waveform up to the intended voltage boosted in the voltage amplifying section 22 to generate drive signals to be applied on recording head 1. Drive signals composed of prescribed drive waveform and drive voltage which are generated here are outputted to recording head 1.

The voltage reading section 25 is composed of an AD converter that reads out voltage from the drive signals immediately after being outputted from the waveform amplifying section 24 and before being applied on recording head 1, and outputs the voltage value resulting from the reading to voltage control section 21.

Figure 5:
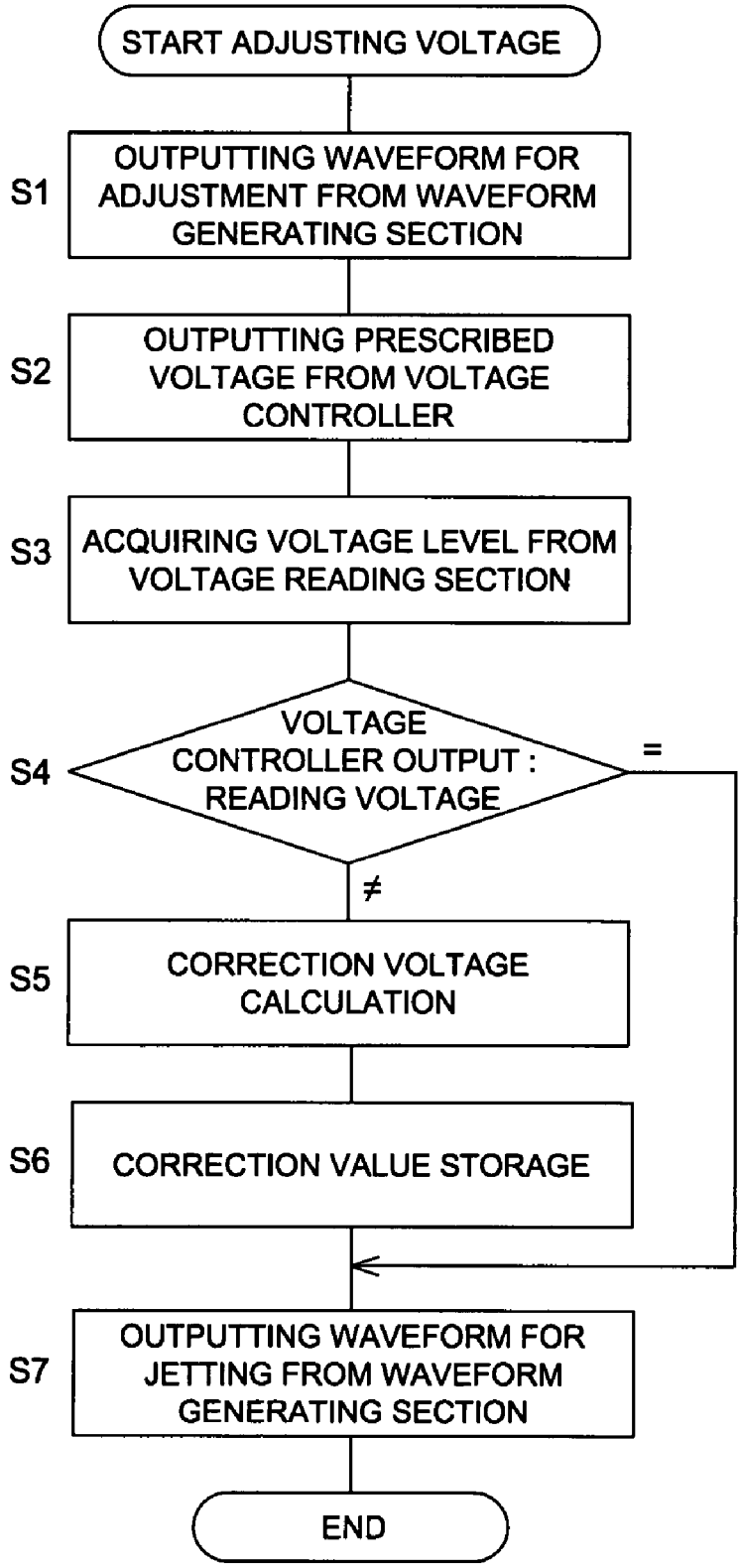
FIG. 5 is a flow chart showing an example of a voltage control method of the present invention.

Next, a voltage control method by the voltage control device 2 will be explained by the use of a flow chart shown in FIG. 5.

When voltage adjustment is required, the waveform generating section 23 switches a waveform to be outputted to waveform for adjustment 232 first, and outputs to waveform amplifying section 24 (S1).

On the other hand, in the voltage control section 21, prescribed voltage to be outputted is determined, and prescribed voltage thus determined is outputted (S2). In this case, it is preferable that a value which is close to jetting voltage necessary for jetting ink droplets from recording head 1 actually is outputted. This prescribed voltage determined by the voltage control section 21 is boosted in the voltage amplifying section 22, and is further combined, at waveform amplifying section 24, with waveform for adjustment 232 outputted from waveform generating section 23 to be outputted to recording head 1.

Then, voltage of signals immediately after being outputted from the waveform amplifying section 24 is read by voltage reading section 25 to be AD-converted, and its voltage value is inputted in the voltage control section 21 (S3).

In this case, the voltage control section 21 compares a voltage value (output voltage) in the case of outputting in the aforesaid step S2 with a voltage value (input voltage) inputted from the voltage reading section 25 (S4).

When the output voltage is not equal to the input voltage after the comparison, the voltage control section 21 judges that the prescribed voltage determined in the aforesaid step S2 is not obtained, and calculates the correction rate for achieving output voltage=input voltage, based on the difference between output voltage and input voltage (S5), to store this value in correction value storing means 211 as a correction value (S6).

On the other hand, in the aforesaid step S4, when the output voltage is equal to the input voltage, the voltage control section 21 judges that the prescribed voltage determined in the aforesaid step S2 is obtained, and voltage correction is not needed in particular, and the voltage correction is terminated.

After that, voltage having a value obtained by multiplying a voltage value established by the outside by the correction value stored in the correction value storing means 211 is established, and in waveform generating section 23, waveform for jetting 231 is selected and outputted, thus, the drive signal by the intended accurate voltage is applied on recording head 1 (S7).

As stated above, in the voltage control device and the voltage controlling method relating to the invention, the waveform generating section 23 switches to waveform for adjustment 232 representing the second drive waveform to output it, and a voltage value of the waveform for adjustment 232 is read immediately after it is amplified and outputted by waveform amplifying section 24, whereby, the voltage including an amount of amplification at the waveform amplifying section 24 under the condition immediately before being applied on recording head 1, can be measured in the simple structure, and voltage correction can be conducted based on the foregoing, thus, the drive voltage to be applied on recording head 1 can be controlled accurately.

Though voltage control is conducted for a single recording head 1 in the first embodiment stated above, the number of recording heads may also be plural. In this case, a plurality of voltage reading sections 25 may also be provided to correspond respectively to plural recording heads, but it is preferable to provide a single common voltage reading section for plural recording heads, and to provide a selecting means that selects the voltage to be corrected in terms of voltage among respective voltages for plural recording heads.

Figure 6:
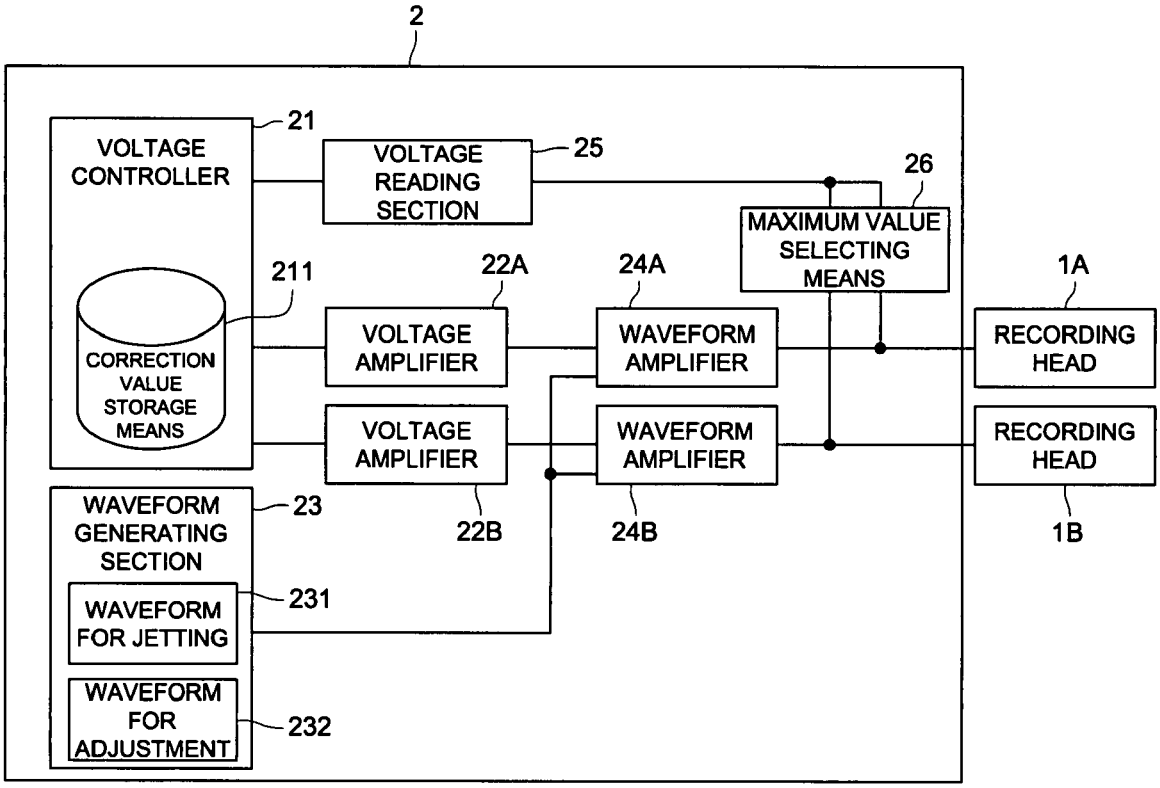
FIG. 6 is a block diagram showing an example of a voltage control device relating to the second embodiment of the present invention.

FIG. 6 is a block diagram showing an example of a preferable voltage control device that is related to the second embodiment of the invention and has a single common voltage reading section for plural recording heads. Those in FIG. 6 having the same symbols as those in FIG. 1 are of the same structure, and explanation for them will be omitted here accordingly.

Voltage control device 2 in the present embodiment is arranged to output drive voltage for each of two recording heads 1A and 1B, and voltage amplifying sections 22A and 22B and waveform amplifying sections 24A and 24B are provided so that they may correspond respectively to recording heads 1A and 1B. Further, drive waveform outputted from the waveform generating section 23 is arranged to be inputted in each of waveform amplifying sections 24A and 24B.

In the voltage control device 2, drive voltage immediately after being outputted from each of waveform amplifying sections 24A and 24B is arranged to be inputted in one voltage reading section 25 through maximum value selecting means 26.

The maximum value selecting means 26 selects the maximum value among drive voltages outputted respectively to respective recording heads 1A and 1B, and outputs only voltage of the selected maximum value to the voltage reading section 25.

Corresponding to this, it is possible to establish voltage independently for each of recording heads 1A and 1B, in voltage control section 21. Therefore, it is possible to establish different voltages at recording heads 1A and 1B, and thereby to make a difference in voltage level to be between recording head 1A and recording head 1B.

Owing to the aforesaid structure, when conducting voltage correction for plural recording heads 1A and 1B in voltage control section 21, if voltage higher than other recording heads 1A and 1B is established on recording heads 1A and 1B to be corrected in terms of voltage, it is possible for voltage reading section 25 to read only the voltage value of the maximum value among others owing to the maximum value selecting means 26, and thereby, the recording head to be corrected in terms of voltage can be specified, and yet, when reading voltage values, drive voltages of other recording heads have no influence, thus, there is no fear of damaging recording heads 1A and 1B.

It is preferable that the maximum value selecting means 26 of this kind has a structure wherein a signal line that reads out voltage after being amplified by each of waveform amplifying sections 24A and 24B is connected on a wired OR basis, and a single output signal line is provided for plural input signal lines corresponding to respective recording heads 1A and 1B. If the structure like this is employed, the number of signal lines for outputting to voltage reading section 25 can be less than the number of output signal lines for outputting to respective recording heads 1A and 1B from waveform amplifying sections 24A and 24B, whereby, a reduction of a scale of circuits, namely, a reduction of a circuit board and a cost reduction become possible. Moreover, accuracy of reading voltage becomes stable, and accurate voltage correction becomes possible, because voltages to be applied on respective recording heads 1A and 1B are read out by a single common voltage reading section 25.

If the maximum value selecting means 26 is constituted with a diode array, the scale of circuits can further be made smaller, and further cost reduction can be achieved, which is preferable.

Figure 7:
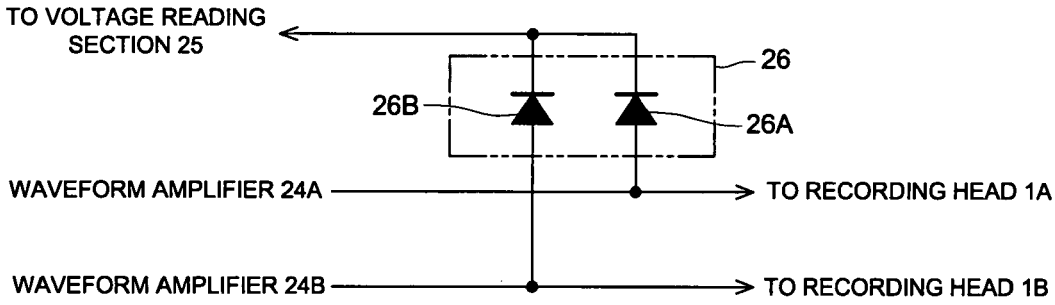
FIG. 7 is a drawing showing an example of the selector which selects the maximum voltage.

FIG. 7 shows an occasion where the maximum value selecting means 26 is constituted with a diode array connected on a wired OR basis. Owing to this, an anode of the diode array 26A on one side constituting the maximum value selecting means 26 is connected with an output signal line from waveform amplifying section 24A, and an anode of the diode array 26B on the other side is connected with an output signal line from waveform amplifying section 24B. Cathodes of respective diode arrays 26A and 26B are collected into a single output signal line and connected with voltage reading section 25.

Since voltage flowing in diode array 26A or 26B on one side does not flow in diode array 26B or 26A on the other side, the maximum value selecting means 26 of this kind has also a function to protect the recording head which is nontarget for voltage correction, preventing a back current of voltage.

Though voltage values of drive signals for recording heads 1A and 1B inputted respectively in the maximum value selecting means 26 have only to be different in terms of a height, if voltage for a nontarget recording head for voltage correction is set to 0 V in voltage control section 21 in voltage control device 2 having the maximum value selecting means 26 shown in FIG. 7, the recording head to be corrected in terms of voltage can be specified in the easiest way, which is preferable.

Figure 8:
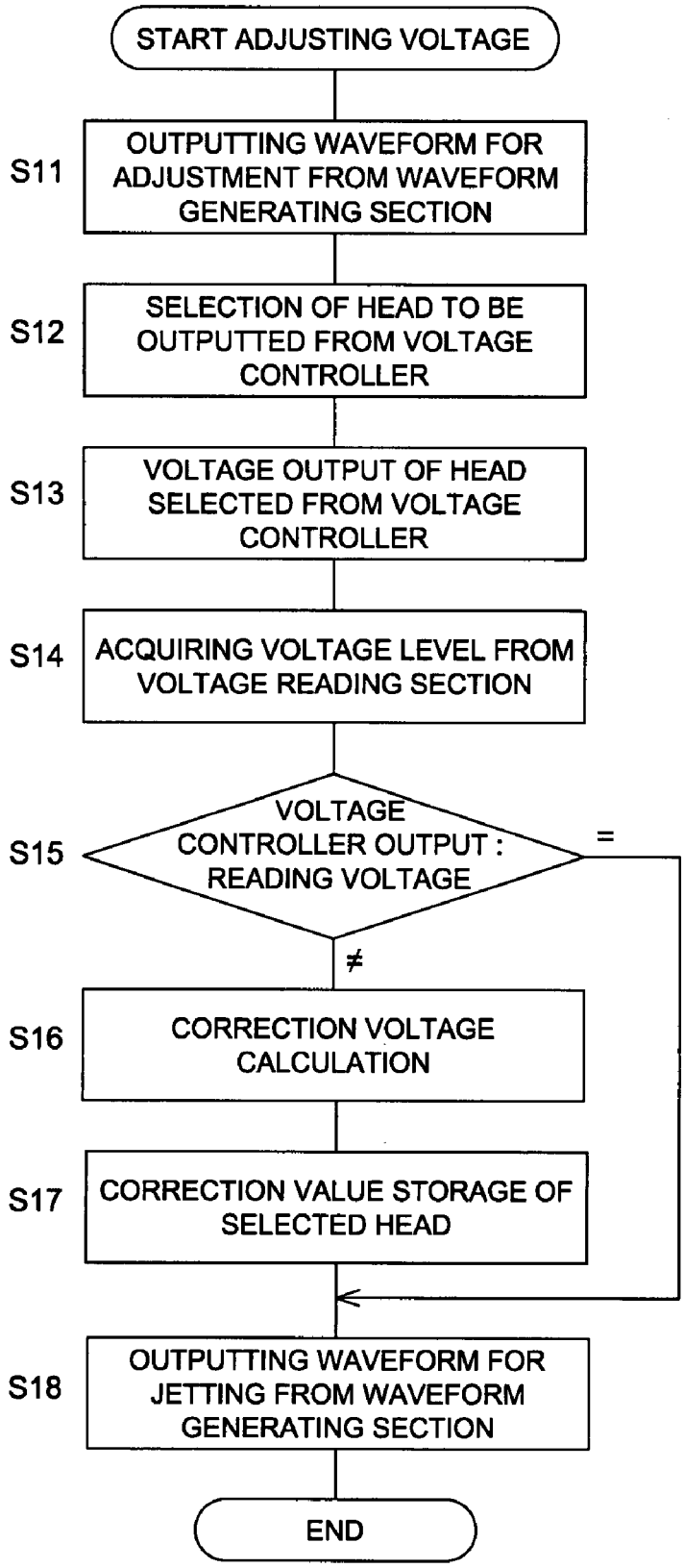
FIG. 8 is a flow chart showing an example of a voltage control method of the present invention.
Figure 9:
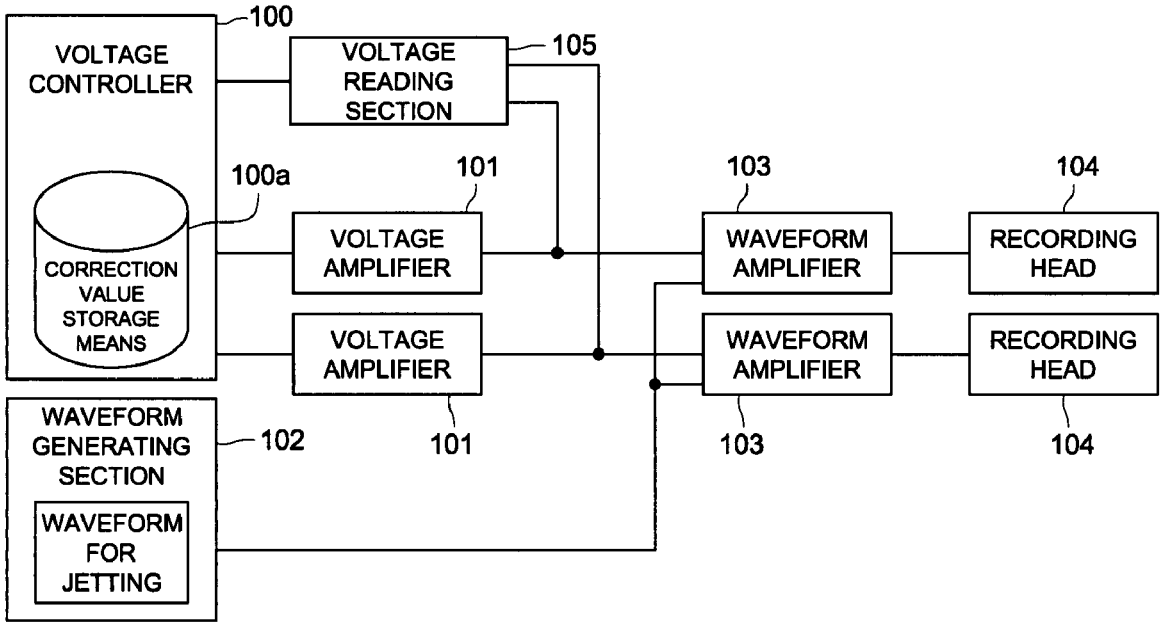
FIG. 9 is a block diagram showing an example of a voltage control device relating to the prior art.

A voltage controlling method by means of the voltage control device 2 of this kind will be explained as follows, referring to the flow chart shown in FIG. 8.

When voltage adjustment is required, waveform generating section 23 first switches a waveform to be outputted to waveform for adjustment 232 to output it to waveform amplifying sections 24A and 24B (S11).

In the voltage control section 21, on the other hand, voltage is outputted, and a recording head to be corrected in terms of voltage is selected (S12). In this case, the explanation will be given under the assumption that recording head 1A is made to be corrected in terms of voltage first.

Then, in the voltage control section 21, prescribed voltage ($\neq$0 V) to be outputted to the recording head 1A is determined, and the prescribed voltage thus determined is outputted (S13). In this case, it is preferable that a value that is close to voltage for jetting necessary for jetting ink droplets actually from recording head 1 is outputted. For recording head 1B on the other side that is nontarget for voltage correction, voltage of 0 V is established.

Voltage determined by the voltage control section 21 is boosted at voltage amplifying sections 22A and 22B, and is further combined with waveform for adjustment 232 outputted from waveform generating section 23 at each of waveform amplifying sections 24A and 24B, to be outputted respectively to recording head 1A and recording head 1B. In this case, voltage of 0 V is established on recording head 1B in the voltage control section 21, whereby, voltage of drive signal outputted from waveform amplifying section 24B is 0 V.

Then, each voltage of signals immediately after being outputted respectively from waveform amplifying sections 24A and 24B is inputted in the maximum value selecting means 26. In this case, signals of prescribed voltage (≠0 V) are inputted from the waveform amplifying sections 24A, and signals of voltage of 0 V are inputted from the waveform amplifying sections 24B. Only maximum voltage among the foregoing is outputted to voltage reading section 25 from the maximum value selecting means 26, and its voltage value is read out by the voltage reading section 25 to be AD-converted, and is inputted in voltage control section 21 (S14).

Here, the voltage control section 21 compares a voltage value (output voltage) for recording head 1A representing a target of voltage correction in the case of outputting in the aforesaid step S13 with a voltage value (input voltage) inputted from voltage reading section 25 (S15).

In the case of output voltage≠input voltage, as a result of the comparison, the voltage control section 21 judges that prescribed voltage exactly the same as that determined in the aforesaid step S13 is not obtained for recording head 1A to be corrected in terms of voltage, and calculates a correction rate that satisfies output voltage=input voltage based on a difference between the output voltage and the input voltage (S16), to store this value of the correction rate in correction value storing means 211 as a correction value for the recording head 1A (S17).

On the other hand, in the case of output voltage=input voltage, in the aforesaid step S15, the voltage control section 21 judges that prescribed voltage exactly the same as that determined in the aforesaid step S13 is obtained for recording head 1A to be corrected in terms of voltage and voltage correction is not needed in particular, thus, voltage adjustment for the recording head 1A is terminated.

After that, voltage having a value obtained by multiplying a voltage value established from the outside by a correction value stored in correction value storing means 211 is established for the recording head 1A, and waveform for jetting 231 is selected at waveform generating section 23 to be outputted, thereby, drive signals based on intended and accurate voltage are applied on the recording head 1A (S18).

Incidentally, when voltage correction is required even for recording head 1B on the other side, the recording head 1B may be selected in place of recording head 1A in the aforesaid step S12.

Though two recording heads 1A and 1B are subjected to voltage control in the present Second Embodiment, the number of recording heads may naturally be three or more.

In the meantime, though voltage control is conducted for each recording head for both of the First Embodiment and the Second Embodiment, it is also possible to conduct the voltage control for each nozzle of the recording head.

When there are plural nozzles, voltage amplifying sections 22A, 22B . . . and waveform amplifying sections 24A, 24B . . . may be provided on each nozzle by using voltage control device 2 shown in FIG. 6. Even in this case, it is preferable to arrange so that voltage values for respective nozzles may be read commonly by single voltage reading section 25, by providing maximum value selecting means 26 in the same way as in FIG. 6.

Figure 10:
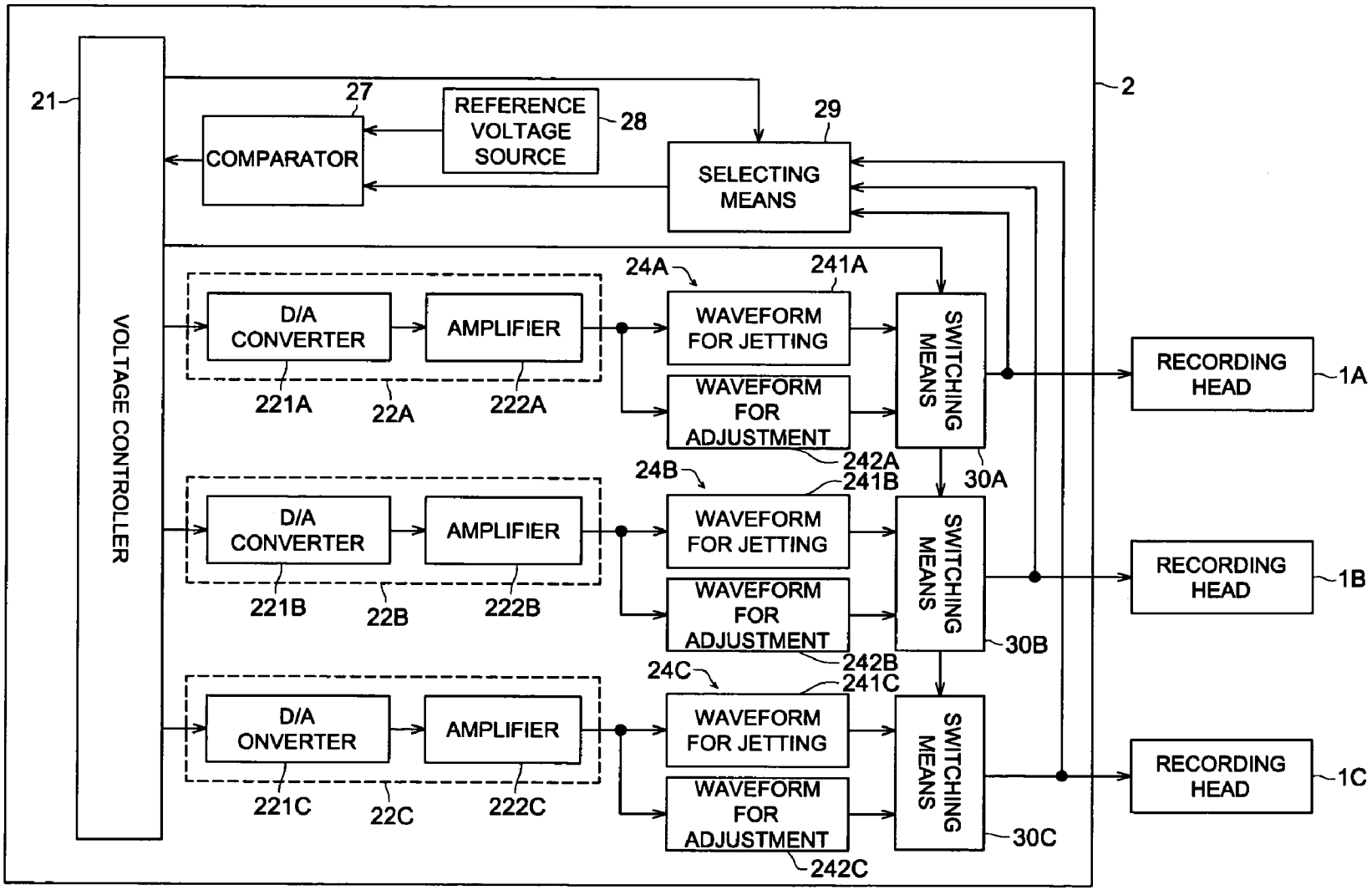
FIG. 10 is a block diagram showing an example of a voltage control device relating to the third embodiment of the present invention.

FIG. 10 is a block diagram showing an example of a preferable voltage control device which relates to the Third Embodiment of the invention and has comparator 27, reference voltage source 28 and selecting means 29 for plural recording heads. Since the symbols which are the same as those in FIG. 1 are of the same structure, detailed illustrations for them will be omitted here.

The voltage control device 2 that controls voltage for driving the recording head 1 of this kind has therein voltage control section 21, voltage amplifying sections 22A, 22B and 22C, waveform amplifying sections 24A, 24B and 24C, switching means 30A, 30B and 30C, selecting means 29, comparator 27 and reference voltage source 28, as shown in FIG. 10. Meanwhile, each of the voltage amplifying sections 22A, 22B and 22C is constructed in a way that the voltage amplifying section 22A includes D/A converter 221A and amplifier 222A, the voltage amplifying section 22B includes D/A converter 221B and amplifier 222B, and the voltage amplifying section 22C includes D/A converter 221C and amplifier 222C.

The voltage control section 21 is provided with a voltage determining function to determine voltage value Vtrg to be established for each of the D/A converters 221A-221C so that intended voltage may be applied on each of recording heads 1A-1C and with a voltage adjustment function for determining a new voltage value again from output coming from comparator 27, and is composed of CPU.

It is further possible to be provided with a correction value calculating function for calculating a correction value from output coming from comparator 27, and to provide correction value storing means 211 (not shown) that stores the correction value calculated by the aforesaid correction value calculating function.

The voltage determining function in voltage control section 21 determines the maximum voltage level of drive signals to be applied on recording heads 1A-1C, and it conducts controlling for establishing the determined maximum voltage level on each of D/A converters 221A-221C. Further, the voltage adjustment function determines the voltage value determined by the aforesaid voltage determining function and established on each of D/A converters 221A-221C again based on output from comparator 27, and conducts controlling for establishing newly the voltage value which has been determined again on each of D/A converters 221A-221C.

The D/A converters 221A-221C are provided to correspond respectively to recording heads 1A-1C, and they establish voltage values to be applied on recording heads 1A-1C, under the control of voltage control section 21.

The amplifiers 222A-222C are provided to correspond respectively to recording heads 1A-1C, and each of the amplifiers is composed of an amplification equipment such as OP amp that conducts voltage amplification at a prescribed amplification factor to achieve voltage value established on each of D/A converters, and boosts up to the maximum voltage level necessary in recording heads 1A-1C.

Each of waveform amplifying sections 24A-24C generates a shape of a waveform to be outputted to each of recording heads 1A-1C. In the waveform amplifying sections 24A-24C, waveforms in plural types of shapes can be generated, and in this case, waveform for jetting generating sections 241A-241C generating waveform for jetting in a waveform shape consisting of a rectangular wave shown in FIG. 4(*a*) that is used for jetting ink droplets normally and waveform for adjustment generating sections 242A-242C generating waveform for adjustment that is used for voltage adjustment, for example, are provided, so that waveforms of at least two types of shapes may be generated.

In the waveform amplifying sections 24A-24C in the Third Embodiment, waveform for jetting generating sections 241A-241C and waveform for adjustment generating sections 242A-242C generating waveform for adjustment, are provided. However, it is also possible to provide a waveform generating section and a waveform for adjustment generation section separately from a waveform amplifying section, as in the First Embodiment stated above.

A waveform for jetting generated in each of waveform for jetting generating sections 241A-241C is made to be voltage related to voltage established by each of the aforesaid D/A converters 221A-221C by voltage amplified by each of amplifiers 222A-222C, and is outputted to each of switching means 30A-30C.

Further, a waveform for adjustment generated in each of waveform for adjustment generating sections 242A-242C has a voltage portion identical to that of voltage related to voltage established by each of the aforesaid D/A converters 221A-221C by voltage amplified by each of amplifiers 222A-222C, and is outputted to each of switching means 30A-30C.

In the invention, in particular, if the waveform for adjustment generated in each of the waveform for adjustment generating sections 242A-242C is in a DC waveform shown in FIG. 4(*b*), voltage at a fixed level can be maintained constantly, resulting in a simple structure for voltage reading in the later step, which is preferable.

Switching means 30A-30C are provided to correspond respectively to recording heads 1A-1C, and switch a waveform that is outputted actually among respective waveforms generated in waveform amplifying sections 24A-24C to any form. The waveform which has been switched in switching means 30A-30C is outputted to each of recording heads 1A-1C. These switching means 30A-30C are controlled by a command from voltage control section 21.

Selecting means 29 is switched by switching means 30A-30C, then, reads out the waveforms to be outputted to respective recording heads 1A-1C, and selects any one of waveforms to be adjusted in terms of voltage to output it. This selecting means 29 is also controlled by a command from voltage control section 21.

Comparator 27 is composed, for example, of a comparator that compares voltage of any waveform selected by selecting means 29 with prescribed reference voltage Vref supplied from reference voltage source 28, and outputs the result of the comparison showing whether the voltage outputted from the selecting means 29 is higher or lower than the reference voltage Vref, to the voltage control section 21.

The reference voltage source 28 generates voltage corresponding to the maximum voltage level of intended voltage that is needed in respective recording heads 1A-1C, and outputs it to comparator 27 as reference voltage Vref.

Figure 11:
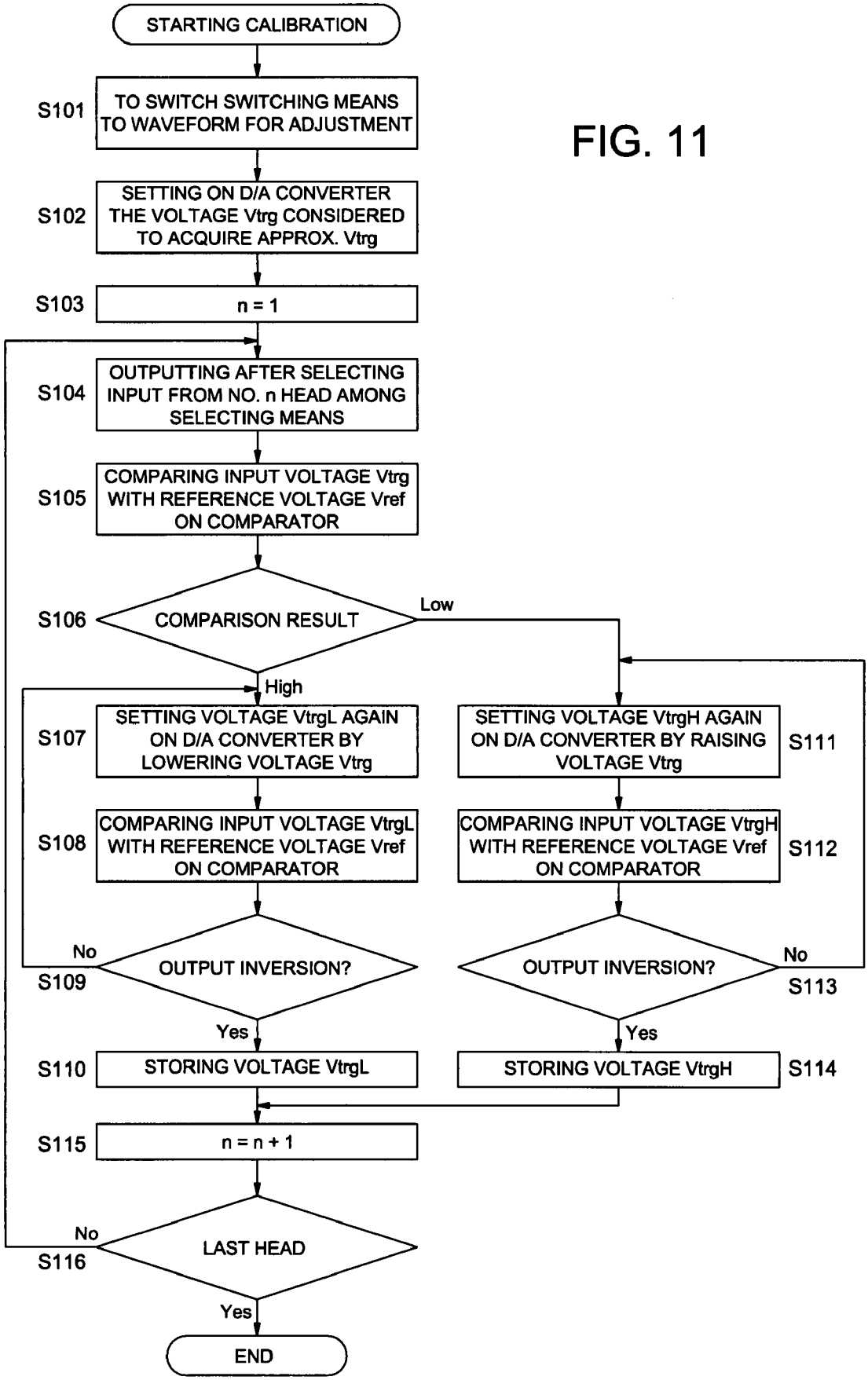
FIG. 11 is a flow chart showing an example of a voltage control method of the present invention.

Next, operations of voltage control device 2 in the Third Embodiment will be explained as follows, referring to the flow chart shown in FIG. 11.

When calibration is required, the voltage control section 21 switches first the waveforms outputted from waveform amplifying sections 24A-24C to waveforms for adjustment generated in waveform for adjustment generating sections 242A-242C (S100).

Then, the voltage control section 21 determines respective voltages Vtrg with which necessary voltages for recording heads 1A-1C are considered to be obtained, and establishes the determined voltages Vtrg on respective D/A converters 221A-221C (S102).

In this case, n=1 is established as recording head No. n for the first voltage adjustment (S103).

Voltages Vtrg established on D/A converters 221A-221C are amplified in amplifiers 222A-222C, and inputted respectively in selecting means 29 through switching means 30A-30C as voltages of waveform for adjustment generated in waveform for adjustment generating sections 242A-242C. Here, the selecting means 29 selects the input from No. 1 recording head 1A set by voltage control section 21, and outputs it to comparator 27 (S104).

In comparator 27, voltage Vtrg of recording head 1A inputted from selecting means 29 is compared with reference voltage Vref supplied from reference voltage source 28 (S105), and the result of the comparison showing whether the voltage Vtrg inputted from the selecting means 29 is higher or lower than the reference voltage Vref is outputted to the voltage control section 21 (S106).

As a result, when the voltage Vtrg is higher than the reference voltage Vref, the voltage control section 21 establishes again voltage Vtrg established on D/A converter 221A corresponding to recording head 1A, namely, new voltage VtrgL wherein a predetermined prescribed amount is made small, on D/A converter 221A, and causes it to be outputted from selecting means 29 in the same way (S107).

In the comparator 27, new voltage VtrgL inputted from selecting means 29 is compared with reference voltage Vref, and a result of the comparison is outputted to the voltage control section 21 (S108).

In this case, the voltage control section 21 judges whether the output from the comparator 27 is reversed or not, namely, whether the output from the comparator 27 is switched to be lower or not (S109), and when it is not reversed (in the case of No in S109), the flow returns to the aforesaid S107, and the voltage control section 21 establishes again voltage VtrgL2 wherein a prescribed amount is made smaller on D/A converter 221A, from voltage VtrgL established on D/A converter 221A corresponding to recording head 1A, and causes it to be outputted from the selecting means 29 in the same way, and the voltage control section 21 repeats the same process until the output from the comparator 27 is reversed.

When the output from the comparator 27 is reversed (in the case of Yes in S109), the voltage Vtrg at that time is stored (S110).

When the voltage Vtrg is lower than the reference voltage Vref after a result of the aforesaid step S106, the voltage control section 21 establishes again new voltage VtrgH wherein a predetermined prescribed amount is made larger on D/A converter 221A, from the voltage Vtrg established on D/A converter 221A corresponding to recording head 1A, and causes the selecting means 29 to output in the same way (S111).

In the comparator 27, new voltage VtrgH inputted from selecting means 29 is compared with reference voltage Vref, and a result of the comparison is outputted to the voltage control section 21 (S112).

In this case, the voltage control section 21 judges whether the output from the comparator 27 is reversed or not, namely, whether the output from the comparator 27 is switched to be higher or not (S113), and when it is not reversed (in the case of No in S113), the flow returns to the aforesaid S111, and the voltage control section 21 establishes again voltage VtrgH2 wherein a prescribed amount is made larger on D/A converter 221A, from voltage VtrgH established on D/A converter 221A corresponding to recording head 1A, and causes the selecting means 29 to output in the same way, and the voltage control section 21 repeats the same process until the output from the comparator 27 is reversed.

When the output from the comparator 27 is reversed (in the case of Yes in S113), the voltage VtrgH at that time is stored (S114).

After that, n=n+1 is established (S115). In this case, next one to be adjusted in terms of voltage is recording head 1B of No. 2 which is not the last head (No in S115), whereby, operations from the step of the aforesaid S104 are repeated for the recording head 1B of No. 2.

When the aforesaid operations are carried out for all of the recording heads 1A-1C in the same way (Yes in S116), the calibration is terminated.

In the invention, when adjusting voltage, outputting is conducted after switching to waveform for adjustment generated by waveform for adjustment generating sections 242A-242C, in waveform amplifying sections 24A-24C, as stated above, so that a voltage value of the voltage-amplified waveform for adjustment is read out. Thus, voltage including also a portion of voltage amplification in the state immediately before applying on recording heads 1A-1C can be measured by the simple structure, and base on this, voltage adjustment can be conducted and voltage to be applied on recording heads 1A-1C can be controlled accurately.

In addition, an accurate correction value that is free from dispersion can be calculated and reliability for voltage control can be improved, because the voltage read out is compared, in comparator 27, with the reference voltage supplied from reference voltage source 28.

Figure 12:
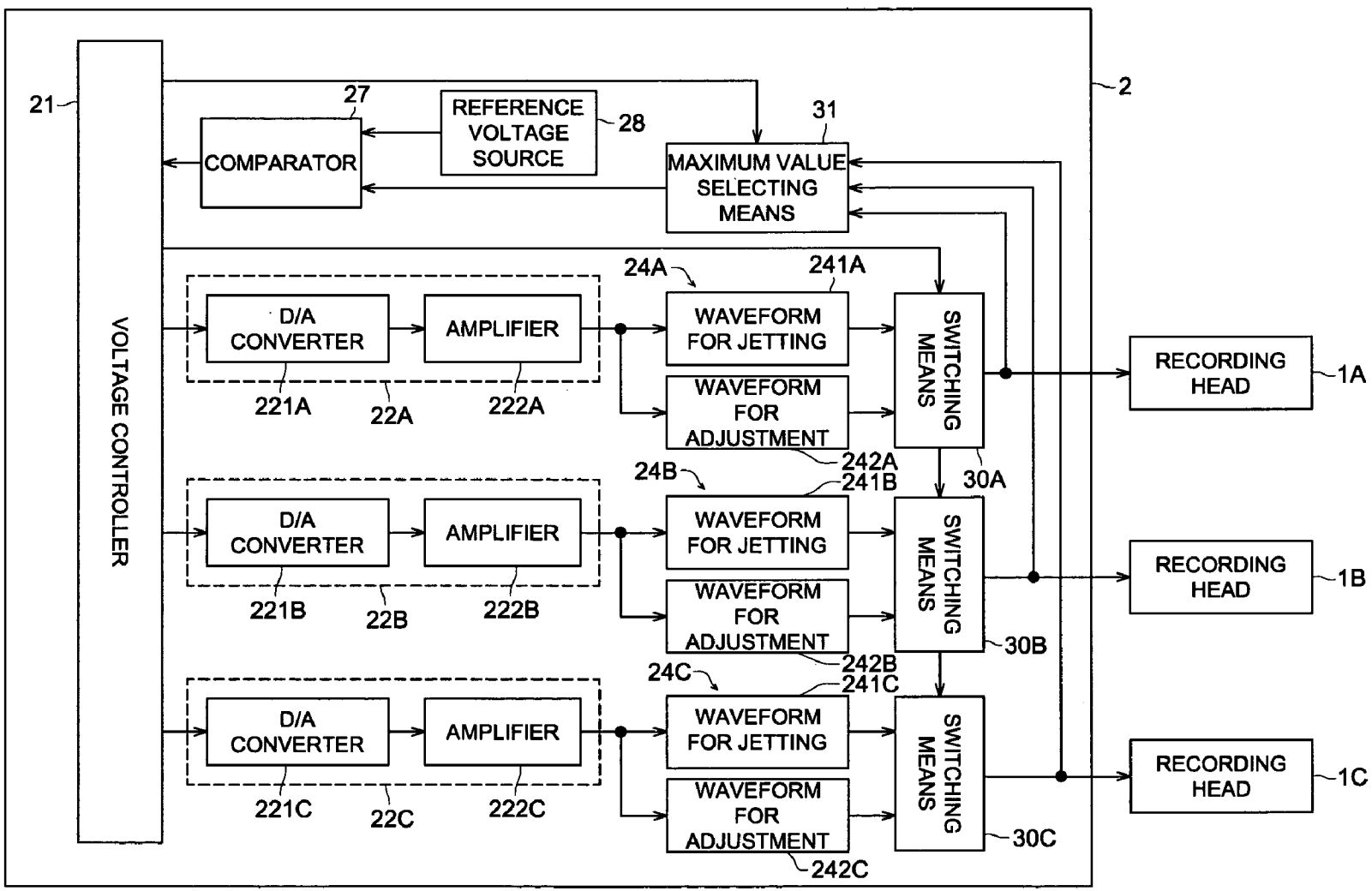
FIG. 12 is a block diagram showing an example of a voltage control device relating to the fourth embodiment of the present invention.

FIG. 12 is a block diagram showing an example of a liquid injection device relating to the Fourth Embodiment of the invention. Those having the same symbols as those in FIG. 10 are of the same structure, and explanation for them will be omitted here accordingly.

In the voltage control device 2, maximum value selecting means 31 is provided in place of selecting means 29 in the Third Embodiment.

The maximum value selecting means 31 selects a waveform having the maximum voltage among waveform voltages outputted to respective recording heads 1A-1C, and outputs the selected waveform only to comparator 27.

Therefore, when conducting voltage adjustment for plural recording heads 1A-1C, if voltage higher than that for other recording heads 1B and 1C is established for recording head 1A to be adjusted in terms of voltage, for example, in voltage control section 21, only signal for recording head 1A having the maximum voltage is outputted to comparator 27 from maximum value selecting means 31. Whereby, it is not necessary to transmit a control command from voltage control section 21 for specifying the recording head to be adjusted in terms of voltage, and the control can be simplified accordingly. In addition, when reading out a voltage value, no influence of voltage of other recording heads is exerted, resulting in no fear of damages on respective recoding heads 1A-1C.

It is preferable that the maximum value selecting means 31 of this kind is of the structure wherein signal lines for reading out voltages after being outputted from respective switching means 30A-30C are connected on a wired OR basis, and a single output signal line is provided for plural input signal lines corresponding to respective recording heads 1A-1C. Owing to this structure, the number of output signal lines becomes less than that of output signal lines outputting to respective recording heads 1A-1C from respective switching means 30A-30C, thus, reduction of a circuit size, namely, reduction of a base board and cost reduction become to be possible. In addition, voltages applied on respective recording heads 1A-1C are read out by a single and common comparator 27, which results in no dispersion of reading accuracy and in accurate voltage adjustment.

If the maximum value selecting means 31 of this kind is constituted with a diode array, the circuit size becomes smaller and further cost reduction is achieved, which is preferable.

Figure 13:
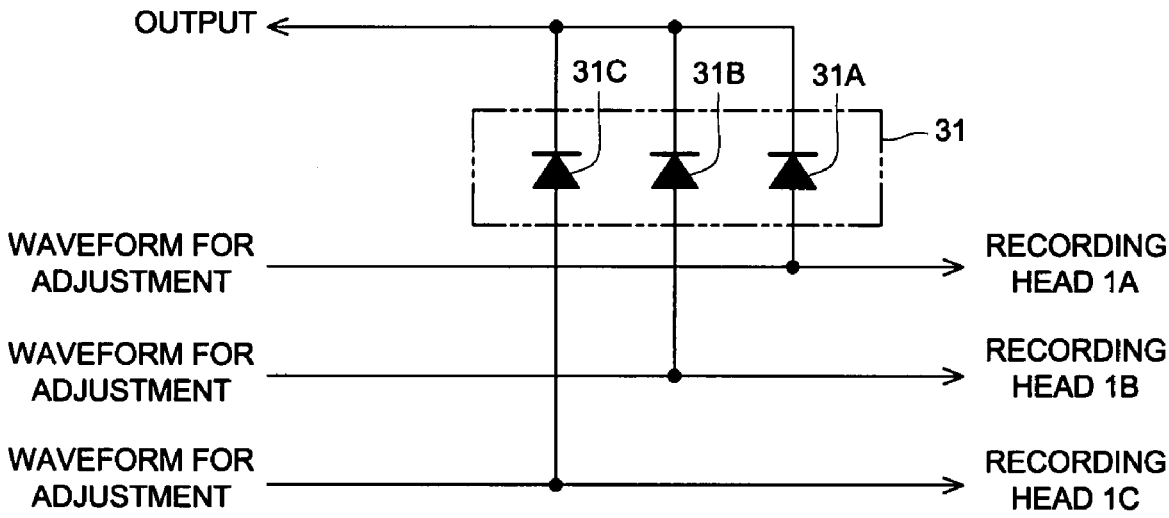
FIG. 13 is a drawing showing an example of the selector which selects the maximum voltage.

FIG. 13 shows an occasion wherein the maximum value selecting means 31 is constituted with a diode array connected on a wired OR connection basis. Due to this, an anode of diode array 31A that constitutes the maximum value selecting means 31 is connected to output signal lines provided from switching means 30A to recording head 1A, an anode of diode array 31B is connected to output signal lines provided from switching means 30B to recording head 1B, and an anode of diode array 31C is connected to output signal lines provided from switching means 30C to recording head 1C. Cathodes of respective diode arrays 31A-31C are outputted after being collected to a single output signal line.

Since the voltage flowing in either one diode array does not flow in other diode arrays as stated above, the maximum value selecting means 31 connected on a wired OR connection basis prevents a backward flow of voltage, and has a function to protect a recording head which is not to be adjusted in terms of voltage.

Voltages for respective recording heads 1A-1C each being inputted in the maximum value selecting means 31 may be different each other. However, in the voltage control device 2 having the maximum value selecting means 31 shown in FIG. 13, if voltage for a recording head which is not to be adjusted in terms of voltage is set to be 0 V in the voltage control section 21, it becomes easy to specify the recording head to be adjusted in terms of voltage, which is preferable.

Figure 14:
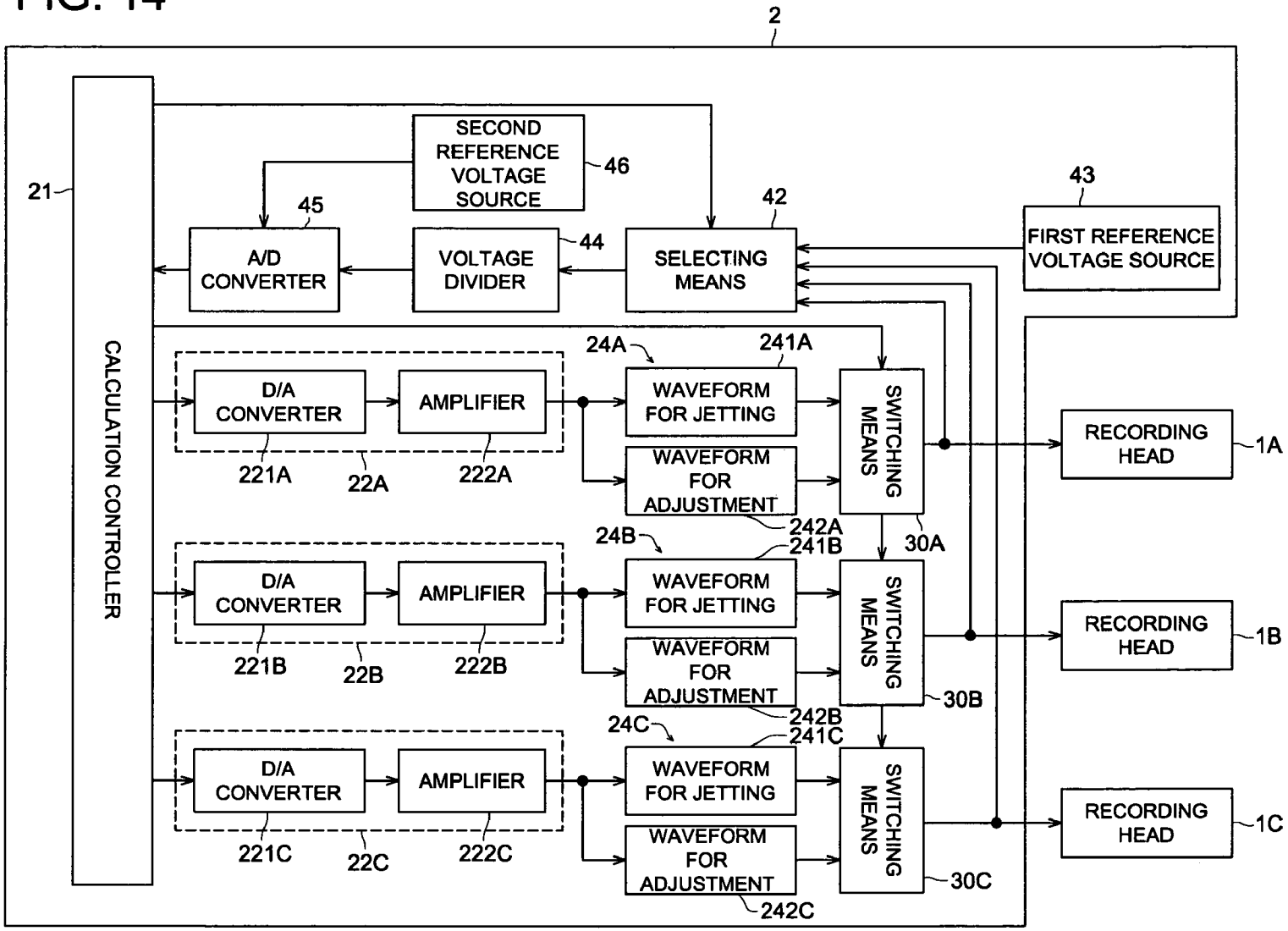
FIG. 14 is a block diagram showing an example of a voltage control device relating to the fifth embodiment of the present invention.

FIG. 14 is a block diagram showing an example of a liquid injection device relating to the Fifth Embodiment of the invention. Those in FIG. 14 having the same symbols as those in FIG. 10 are of the same structure, and explanation for them will be omitted here accordingly.

In this voltage control device 2, the prescribed reference voltage is also inputted from the first reference voltage source 43 into selecting means that reads out voltage outputted to each of recording heads 1A-1C for inputting.

This first reference voltage source 43 generates voltage corresponding to the maximum voltage level of the intended voltage which is necessary in respective recording heads 1A-1C, and outputs it to selecting means 42 as reference voltage Vref.

Following the control command from the voltage control section 21, the selecting means 42 selects either one from voltage Vtrg of waveform for adjustment outputted to each of recording heads 1A-1C and reference voltage Vref inputted from the first reference voltage source 43, to output it.

Voltage outputted from the selecting means 42 is converted to digital value from analog value by A/D converter 45, after being divided in terms of pressure by voltage divider 44 to be a prescribed low voltage. Symbol 46 represents the second reference voltage source that supplies reverence voltage to A/D converter 45.

Figure 15:
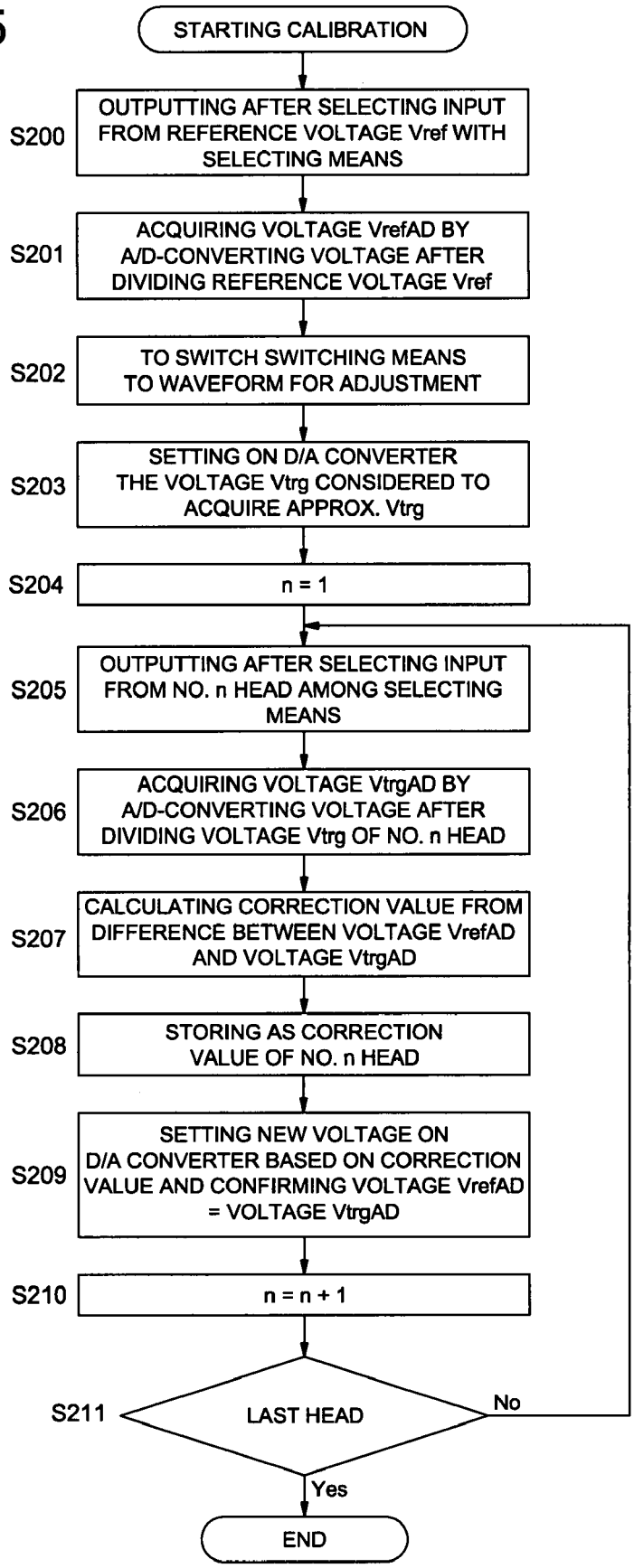
FIG. 15 is a flow chart showing an example of a voltage control method of the present invention.

Next, operations of voltage control device 2 in the Fifth Embodiment will be explained, referring to the flow chart shown in FIG. 15.

When calibration is required, the voltage control section 21 controls the selecting means 42 to select and output reference voltage Vref inputted from the first reference voltage source 43 (S200). Due to this, the reference voltage Vref outputted from the selecting means 42 is divided in terms of voltage into prescribed small voltage by voltage divider 44 in the rear step, and is converted into digital value VrefAD in A/D converter 45 to be outputted to the voltage control section 21. Owing to this, the voltage control section 21 acquires digital value VrefAD of the reference voltage Vref (S201).

Then, the voltage control section 21 switches waveforms outputted from waveform amplifying sections 24A-24C to waveforms for adjustment generated in waveform for adjustment generating sections 242A-242C (S202).

Then, the voltage control section 21 determines respectively voltages Vtrg which are regarded to acquire necessary voltages for recording heads 1A-1C, and establishes the determined voltages Vtrg on respective D/A converters 221A-221C (S203).

In this case, n=1 is established as recording head No. n to be adjusted first in terms of voltage (S204)

Voltages Vtrg established on D/A converters 221A-221C are amplified in amplifiers 222A-222C, and are inputted in selecting means 42 through switching means 30A-30C as voltages in waveform for adjustment generated in waveform for adjustment generating sections 242A-242C (S202). In this case, the selecting means 42 selects an input from No. 1 recording head 1A established by the voltage control section 21, and outputs it to voltage divider 44 (S205).

The voltage Vtrg inputted in the voltage divider 44 is divided into prescribed small voltage, and is converted into digital value VtrgAD in A/D converter 45 to be outputted to the voltage control section 21. Owing to this, the voltage control section 21 acquires digital value VtrgAD of the voltage Vtrg (S206).

In this case, in the voltage control section 21, each digital value VrefAD thus obtained is compared with VtrgAD, and a correction value (a correction rate) for achieving VrefAD=VtrgAD is calculated from a difference between the digital value VrefAD and the VtrgAD (S207), and the correction value is stored as a correction value of No. 1 recording head 1A (S208).

Then, the voltage control section 21 establishes new voltage Vtrg obtained by multiplying the aforesaid voltage Vtrg by the calculated correction value on corresponding D/A converter 221A, and confirms that the digital value VtrgAD acquired in the same way as in the foregoing is equal to Vref (S209).

After that, n=n+1 is established (S210). In this case, the succeeding voltage adjustment is for No. 2 recording head 1B which is not the last head (No in S211), therefore, operations beginning from the aforesaid step S205 are repeated for the No. 2 recording head 1B.

In the same way, the aforesaid operations are conducted on all recording heads 1A-1C (Yes in S211), to complete the calibration.

In the voltage control device 2, the correction value is obtained from the difference between digital value VrefAD acquired by dividing reference voltage Vref in terms of voltage and by A/D-converting and digital value VtrgAD acquired by dividing voltage Vtrg for the recording head to be adjusted in terms of voltage and by A/D-converting, and therefore, it is possible to detect an amount of deviation from the reference voltage which is different from an occasion that shows whether the compared voltage is higher or lower than the reference voltage, as in the case of using a comparator, thus, it is possible to achieve the highly accurate and high speed calibration.

Figure 16:
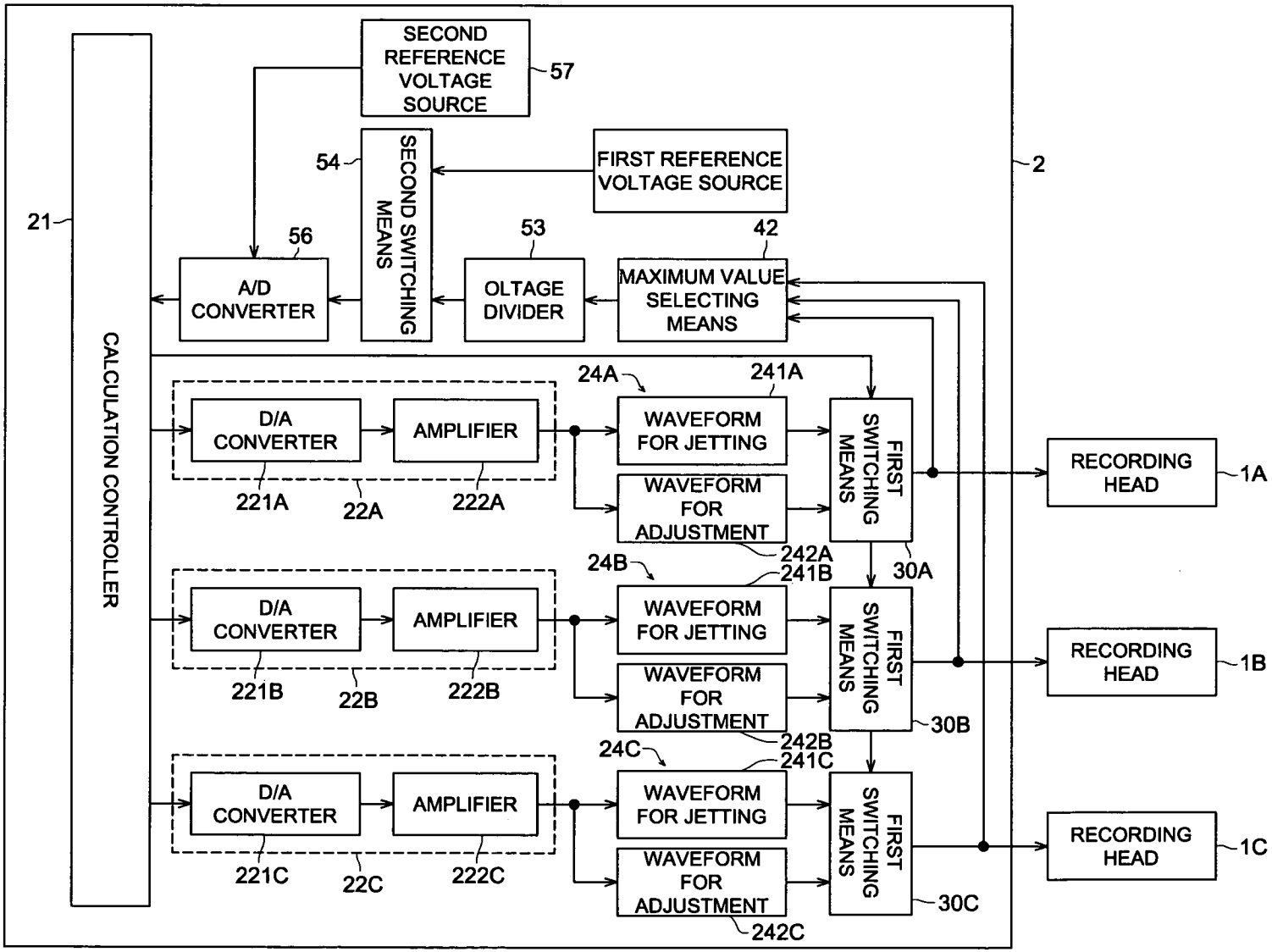
FIG. 16 is a block diagram showing an example of a voltage control device relating to the sixth embodiment of the present invention.

FIG. 16 is a block diagram showing an example of a liquid injection device relating to the Sixth Embodiment of the invention. Those in FIG. 16 having the same symbols as those in FIG. 10 are of the same structure, and explanation for them will be omitted here accordingly.

In the voltage control device 2, the maximum voltage only among respective voltages is outputted to voltage divider 53, as a selecting means to read voltages outputted to respective recording heads 1A-1C to input. Since this maximum value selecting means 52 is of the same structure as in the maximum value selecting means 31 shown in FIGS. 12 and 13, the detailed explanation will be omitted here.

In addition to switching means (first switching means) 30A-30C which switch waveforms outputted from waveform amplifying sections 24A-24C to waveforms for jetting or to waveforms for adjustment, there is further provided second switching means 54.

The second switching means 54 switches to output either one of voltage outputted from the maximum value selecting means 52 and divided by voltage divider 53 to become prescribed small voltage and voltage supplied from the first reference voltage source 55.

The first reference voltage source 55 outputs voltage wherein voltage corresponding to the maximum voltage level of intended voltage that is necessary in each of recording heads 1A-1C is equal to the voltage acquired by dividing by voltage divider 53 to the second switching means 54 as reference voltage Vref.

Voltage outputted from the second switching means 54 is converted to a digital value from an analog value by A/D converter 56. The symbol 57 represents the second reference voltage source that supplies reference voltage to A/D converter 56.

Figure 17:
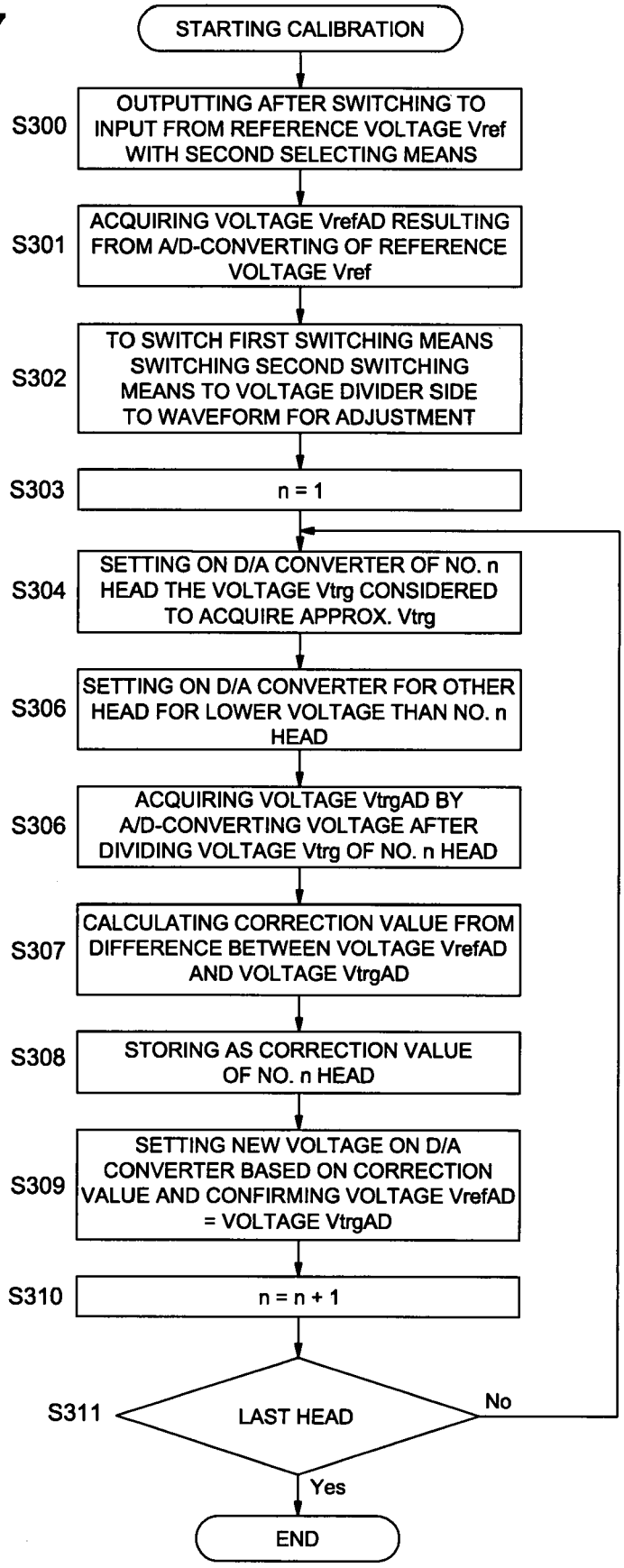
FIG. 17 is a flow chart showing an example of a voltage control method of the present invention.

Next, operations of voltage control device 2 in the Sixth Embodiment will be explained, referring to the flow chart shown in FIG. 17.

When calibration is required, the voltage control section 21 switches and controls the second switching means 54 so that reference voltage Vref inputted from the first reference voltage source 55 may be outputted (S300). Due to this, the reference voltage Vref outputted from the second switching means 54 is converted to digital value VrefAD in A/D converter 56 and outputted to voltage control section 21. Owing to this, the voltage control section 21 acquires digital value VrefAD of the reference voltage Vref (S301).

Then, the voltage control section 21 switches the second switching means 54 so that an input from voltage divider 53 may be outputted, and switches and controls the first switching means 30A-30C for switching waveforms outputted from waveform amplifying sections 24A-24C to waveforms for adjustment generated in waveform for adjustment generating sections 242A-242C (S302).

In this case, n=1 is established as first recording head No. n to be adjusted in terms of voltage (S303).

Then, the voltage control section 21 determines voltage Vtrg which is regarded to acquire necessary voltage for recording head 1A representing No. 1 head, and establishes the determined voltage Vtrg on corresponding D/A converter 221A (S304).

On the other hand, for other recording heads 1B and 1C which are not to be adjusted in terms of voltage in this case, voltage lower than the established voltage for the recording head 1A to be adjusted in terms of voltage, for example, 0 V is established on each of corresponding D/A converters 221B and 221C (S305).

Respective voltages established on D/A converters 221A-221C are amplified in amplifiers 222A-222C, and they are respectively inputted in maximum value selecting means 52 through the first switching means 30A-30C, as voltage of waveform for adjustment generated in waveform for adjustment generating sections 242A-242C. In this case, only voltage for recording head 1A to be adjusted in terms of voltage among respective voltages established on D/A converters 221A-221C is one higher than other voltages, thereby, maximum value selecting means 52 outputs only input from No. 1 recording head 1A to voltage divider 53.

Voltage Vtrg for recording head 1A inputted in voltage divider 53 is divided into prescribed small voltage and is converted to digital value VtrgAD in A/D converter 56 to be outputted to the voltage control section 21. Due to this, the voltage control section 21 acquires digital value VtrgAD of voltage Vtrg (S306).

In this case, in the voltage control section 21, each digital value VrefAD thus obtained is compared with VtrgAD, and a correction value (a correction rate) for achieving VrefAD=VtrgAD is calculated from a difference between the digital value VrefAD and the VtrgAD (S307), and the correction value is stored as a correction value of No. 1 recording head 1A (S308).

Then, the voltage control section 21 establishes new voltage Vtrg obtained by multiplying the aforesaid voltage Vtrg by the calculated correction value on corresponding D/A converter 221A, and confirms that the digital value VtrgAD acquired in the same way as in the foregoing is equal to Vref (S309).

After that, n=n+1 is established (S310). In this case, the succeeding voltage adjustment is for No. 2 recording head 1B which is not the last head (No in S311), therefore, operations beginning from the aforesaid step S304 are repeated for the No. 2 recording head 1B.

In the same way, the aforesaid operations are conducted on all recording heads 1A-1C (Yes in S311), to complete the calibration.

In the voltage control device 2, in the same way as in the Fifth Embodiment, it is possible to detect an amount of deviation from the reference voltage which is different from an occasion that shows whether the compared voltage is higher or lower than the reference voltage, as in the case of using a comparator, thus, it is possible to achieve the highly accurate and high speed calibration. In addition, voltage lower than the necessary voltage for recording heads 1A-1C can be established as reference value Vref to be compared, which is a merit.

Incidentally, in the Sixth Embodiment, it is also possible to arrange so that selecting means 29 that is the same as one in the Third Embodiment is used in place of the maximum value selecting means 52, and voltage to be adjusted is selected and controlled by the control command from the voltage control section 21.

Figure 18:
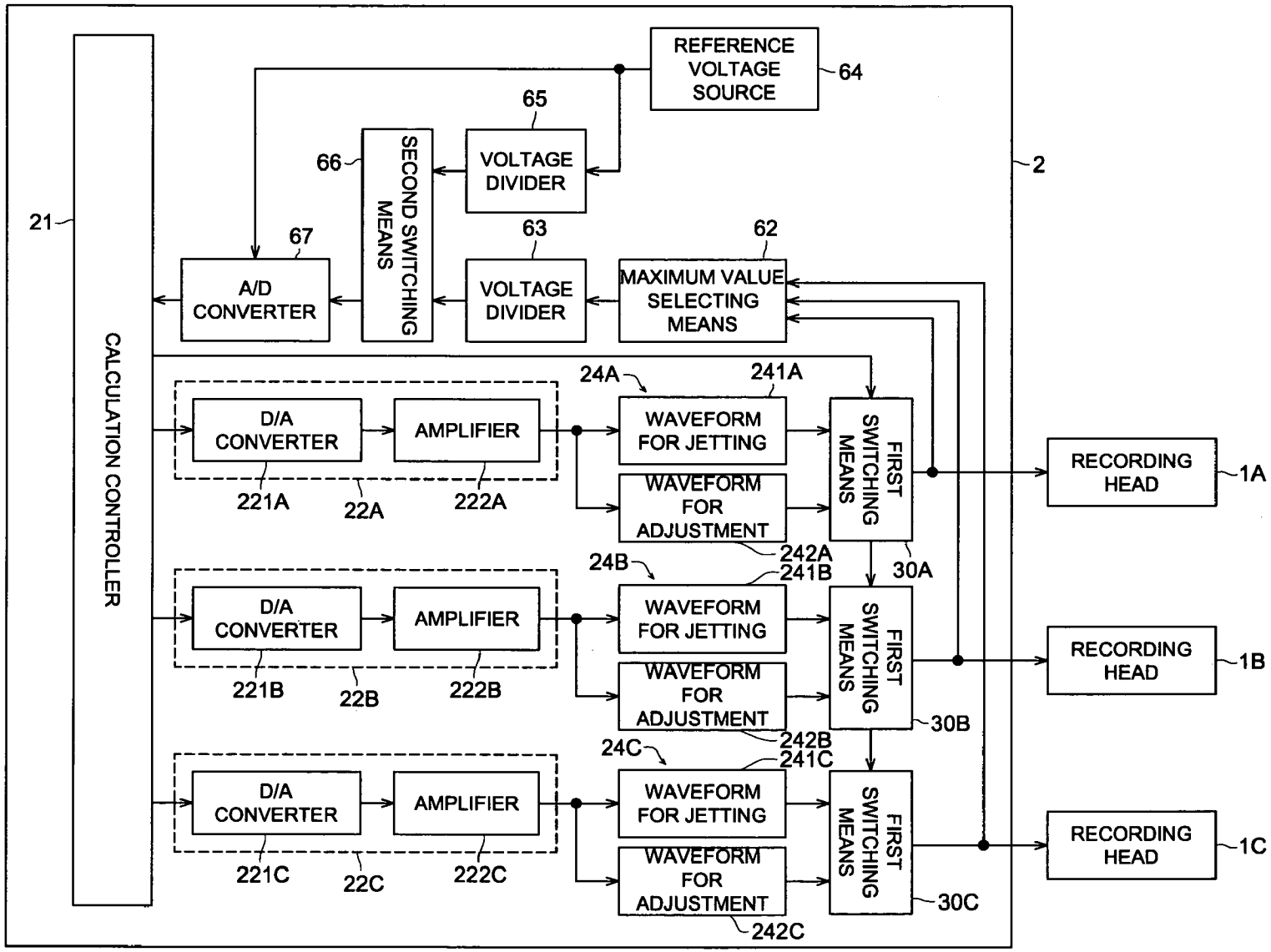
FIG. 18 is a block diagram showing an example of a voltage control device relating to the seventh embodiment of the present invention.

FIG. 18 is a block diagram showing an example of a liquid injection device relating to the Seventh Embodiment of the invention. Those in FIG. 18 having the same symbols as those in FIG. 10 are of the same structure, and explanation for them will be omitted here accordingly.

In the voltage control device 2, reference voltage source 64 that supplies reference voltage to A/D converter 67 is used in common, in place of the first reference voltage source 55 in the Sixth Embodiment.

The reference voltage source 64 outputs also to the second voltage divider 65 so that the reference voltage source 64 may supply voltage to A/D converter 67 as reference voltage and it may supply reference voltage for comparison with voltage outputted to respective recording heads 1A-1C.

The second voltage divider 65 divides voltage supplied from the reference voltage source 64 to output to the second switching means 66, so that voltage that is equivalent to the maximum voltage level among the intended voltages necessary in respective recording heads 1A-1C may become the voltage after being divided by the first voltage divider 63. Voltage outputted from this second voltage divider serves as reference voltage Vref.

The second switching means 66 is controlled to switch to either one of voltage outputted from the maximum value selecting means 62 and divided by the first voltage divider 63 by a control command from the voltage control section 21 and voltage supplied from reference voltage source 64 and divided by the second voltage divider 65 to output. The voltage outputted from this second voltage divider 65 results in reference voltage Vref.

In the voltage control device 2, in the same way as in the Fifth Embodiment, it is possible to detect an amount of deviation from the reference voltage which is different from an occasion that shows whether the compared voltage is higher or lower than the reference voltage, as in the case of using a comparator, thus, it is possible to achieve the highly accurate and high speed calibration. In addition, reference voltage source 64 of A/D converter 67 is used in common for the reference voltage to be compared, which makes only one reference voltage source to be enough, resulting in cost reduction, which is a merit.

Incidentally, in this Seventh Embodiment, it is also possible to arrange to use selecting means 29 in the same way as in the Third Embodiment in place of maximum value selecting means 62, to select and control voltage to be adjusted in terms of voltage following a control command from the voltage control section 21.

Although voltage is outputted for each recording head in each of the aforesaid embodiments, it is also possible to output voltage for each of plural nozzles of the recording head.

Further, when outputting voltage for each recording head, if the recording head is single, electing means 29 in FIG. 1, maximum value selecting means 31 in FIG. 12, maximum value selecting means 52 in FIG. 16 and maximum value selecting means 62 in FIG. 18 are not needed in the structure.

Figure 19:
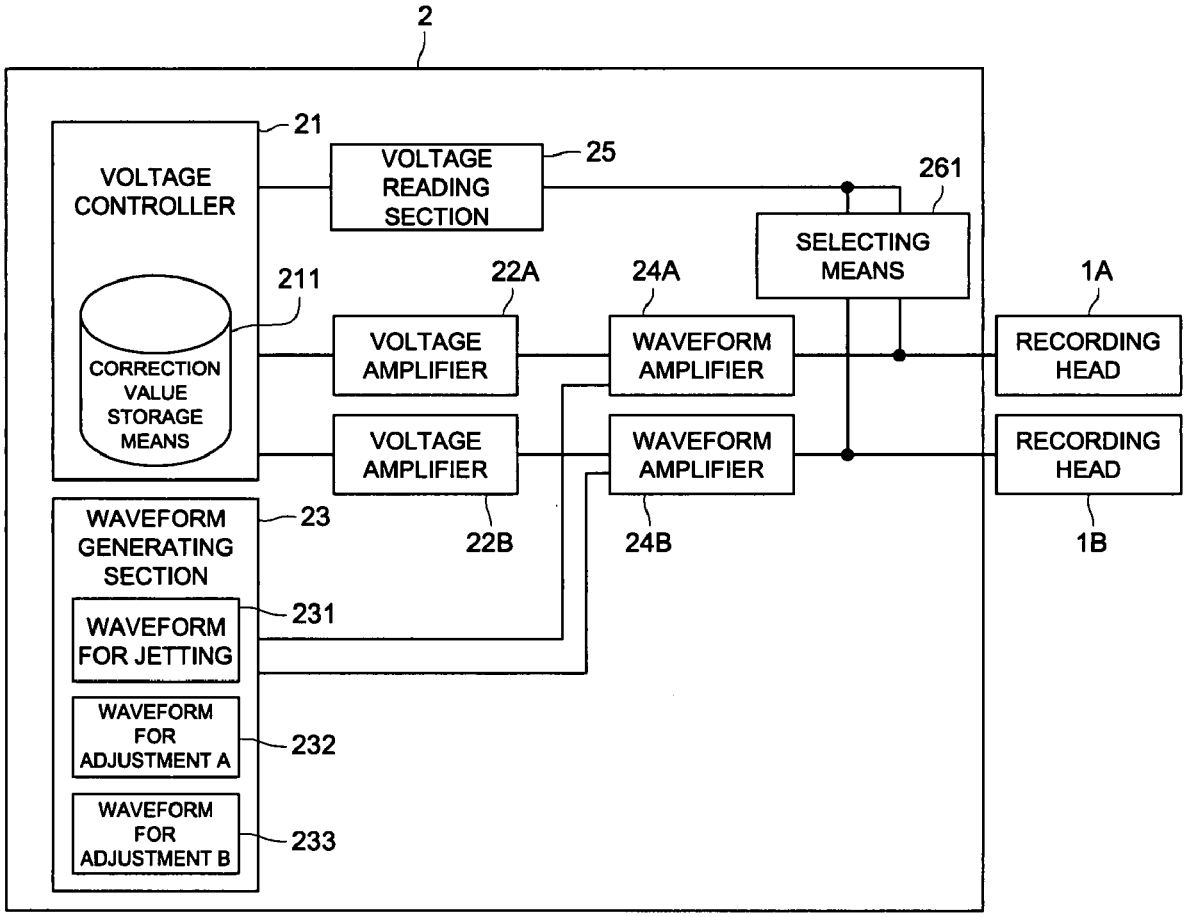
FIG. 19 is a block diagram showing an example of a voltage control device relating to the eighth embodiment of the present invention.

FIG. 19 is a block diagram showing an example of a liquid injection device relating to the Eighth Embodiment of the invention. Those in FIG. 19 having the same symbols as those in FIG. 6 are of the same structure, and explanation for them will be omitted here accordingly.

In the present embodiment, waveform generating section 23 generates a shape of waveform to be applied to respective recording heads 1A and 1B, and outputs to respective waveform amplifying sections 24A and 24B. In this waveform generating section 23, it is possible to generate waveforms in plural types of shapes, and in this case, waveform for jetting generating section 231 that generates a waveform for jetting (first drive waveform), first waveform for adjustment generating section 232 that generates waveform for adjustment A (second drive waveform) and second waveform for adjustment generating section 233 that generates waveform for adjustment B (third drive waveform) are provided.

Figure 4:
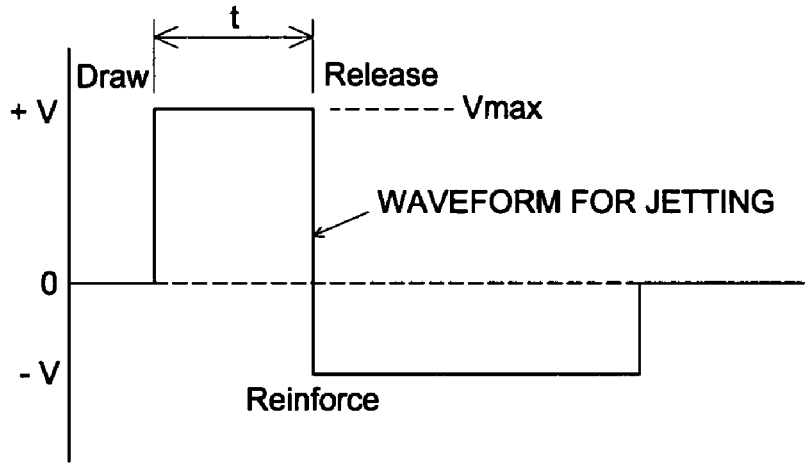
FIGS. 4(*a*), (*b*), and (*c*) are drawings showing examples of waveforms.
Figure 4:
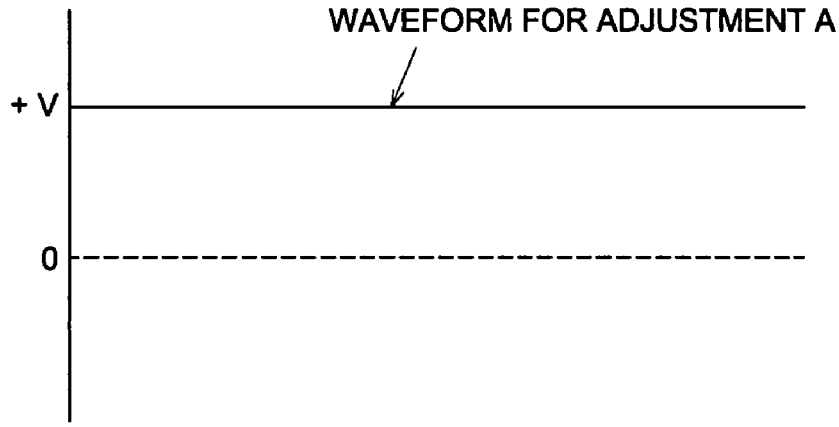
Figure 4:
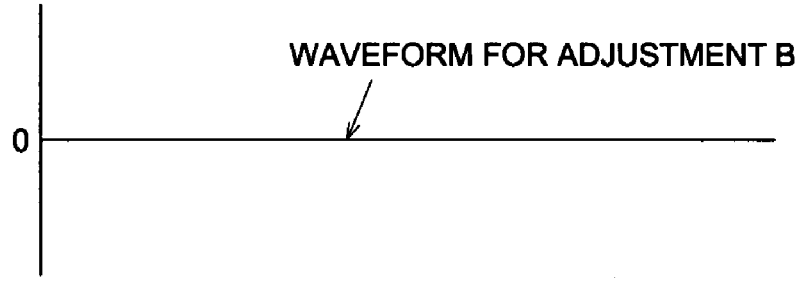

The waveform for jetting generating section 231 generates a waveform for jetting having a shape of a waveform composed of a square wave as shown, for example, in FIG. 4 (*a*). This waveform for jetting is one used usually for jetting ink droplets from respective recording heads 1A and 1B. This waveform for jetting shown in FIG. 4(*a*) is composed of a square wave, and period of time t for maintaining the maximum value Vmax of its voltage is only 2 μs. Therefore, the waveform for jetting of this kind makes it difficult to read out voltage in the course of voltage correction, thus, employment of the structure of the invention under the aforesaid condition gives an effect which is especially remarkable.

First waveform for adjustment generating section 232 generates waveform for adjustment A to be used for recording head 1A or 1B to be adjusted in terms of voltage in the case of voltage correction.

The waveform for adjustment A is a waveform that is different from a waveform for jetting generated by waveform for jetting generating section 231, and is a waveform that makes voltage reading in voltage reading section 25 in the later case to be easy. The waveform of this kind is preferably a waveform having a form that keeps voltage at a fixed level constantly, and it is preferable that the waveform is made to be a direct-current waveform shown, for example, in FIG. 4(*b*) If the waveform for adjustment A is made to be such direct-current waveform, the structure for voltage reading in the later case can be more simple.

Further, if a value of its amplitude is at the same level as that of a value of the maximum amplitude of the waveform for jetting, more accurate voltage correction can be carried out, which is preferable.

Second waveform for adjustment generating section 233 generates waveform for adjustment B used for recording head 1A or recording head 1B which is not to be corrected in terms of voltage in the case of conducting voltage correction.

The waveform for adjustment B is a waveform that is different from the aforesaid waveform for jetting and from waveform for adjustment A, and it is composed of a waveform whose amplitude value is smaller than that of the waveform for adjustment A so that it may be distinguished easily from the aforesaid waveform for adjustment A by selecting means 261 in the later stage.

The waveform for adjustment B is preferably a waveform having a form that keeps voltage at a fixed level constantly again, and it is preferable that its waveform is made to be a direct-current waveform. If a value of its amplitude is 0 as shown in FIG. 4(*c*), the waveform for adjustment B can be distinguished more easily from waveform for adjustment A by selecting means 261 in the later step, which is preferable.

Figure 20:
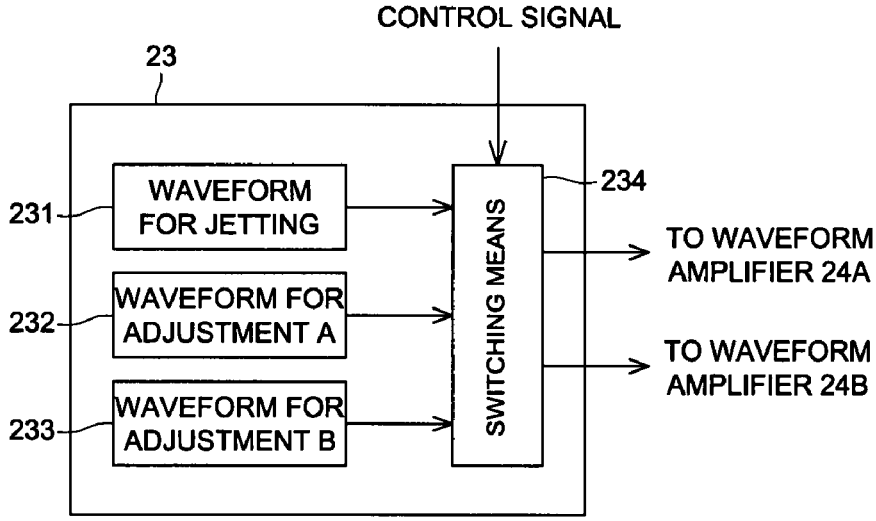
FIG. 20 is a drawing showing an example of the waveform generator.

As shown in FIG. 20, waveform generating section 23 is equipped with switching means 234 that switches to any waveform outputted actually to waveform amplifying sections 24A and 24B from a waveform for jetting, waveform for adjustment A and waveform for adjustment B all generated in the waveform generating section 23. The switching means 234 is controlled by a control signal coming from, for example, voltage control section 21, and outputs any one waveform among a waveform for jetting, waveform for adjustment A and waveform for adjustment B, to respective waveform amplifying sections 24A and 24B.

The switching means 234 has only to switch a drive waveform to any one of a waveform for jetting, waveform for adjustment A and waveform for adjustment B, and the switching means 234 is not always limited to the structure of the waveform generating section 23.

Waveform amplifying sections 24A and 24B are provided, corresponding respectively to recording head 1A and recording head 1B, and they input voltages outputted from voltage amplifying sections 22A and 22B and any waveform outputted from waveform generating section 23, and generates drive signals to be applied on recording heads 1A and 1B. The drive signal having prescribed waveform and voltage generated in the waveform amplifying sections is applied on recording heads 1A and 1B.

In this case, when the waveform outputted from waveform generating section 23 is a waveform for jetting generated in waveform for jetting generating section 231, a waveform for jetting shown in FIG. 4(*a*) is combined with voltage coming from voltage amplifying sections 22A and 22B, in the waveform amplifying sections 24A and 24B. Owing to this, there is outputted a drive signal that makes the maximum voltage value to be the voltage amplified in voltage amplifying sections 22A and 22B.

Further, when the waveform outputted from waveform generating section 23 is waveform for adjustment A generated in the first waveform for adjustment generating section 232, waveform for adjustment A shown in FIG. 4(*b*) is combined with voltage coming from voltage amplifying sections 22A and 22B, in the waveform amplifying sections 24A and 24B. Owing to this, a drive signal that keeps voltage amplified by voltage amplifying sections 22A and 22B to be constant is outputted.

Further, when the waveform outputted from waveform generating section 23 is waveform for adjustment B generated in the second waveform for adjustment generating section 233, waveform for adjustment B shown in FIG. 4(*c*) is combined with voltage coming from voltage amplifying sections 22A and 22B, in the waveform amplifying sections 24A and 24B. Since the waveform for adjustment B shown in FIG. 4(*c*) is a waveform of 0 V, the waveform amplifying sections 24A and 24B output drive signal that keeps voltage (0 V) lower than that of waveform for adjustment A to be constant.

Voltage reading section 25 is composed of an Ad converter that reads out voltage from drive signals immediately after being outputted from waveform amplifying sections 24A and 24B and before being applied on recording heads 1A and 1B, and outputs a voltage value resulting from the reading to voltage control section 21.

Selecting means 261 inputs selectively each drive signal immediately after being outputted from each of waveform amplifying sections 24A and 24B into one voltage reading section 25. Waveforms outputted from waveform generating section 23 in the case of voltage correction include specifically waveform for adjustment A and waveform for adjustment B as stated later, and they are different each other in terms of a value of amplitude. It is therefore preferable that the selecting means 261 is a maximum value selecting means that selects the maximum value (maximum amplitude value) among voltages of drive signals outputted respectively to recording heads 1A and 1B, and outputs only drive signals having the selected voltage of the maximum value to the voltage reading section 25.

Owing to this structure, when conducting voltage correction for a plurality of recording heads 1A and 1B in voltage control section 21, if waveform for adjustment A is outputted to recording head 1A or 1B to be corrected in terms of voltage and waveform for adjustment B is outputted to recording head 1B or 1A which is not to be corrected in terms of voltage, only voltage of drive signal having the maximum voltage can be read by voltage reading section 25 in the selecting means 261. Therefore, it is not necessary to output a control signal and to switch and control, and recording head to be corrected in terms of voltage can be specified, and voltage of its drive signal can be read out. In addition, when reading out voltage, voltages of drive signals to be applied on other recording heads have no influence, whereby, there is no fear that recording heads 1A and 1B are damaged, even when waveform for adjustment has intermediate voltage.

It is preferable that the selecting means 261 of this kind is of the structure wherein a signal line that reads out voltage after being amplified by each of waveform amplifying sections 24A and 24B is connected on a wired OR basis, and a single output signal line is provided for a plurality of input signal lines corresponding to respective recording heads 1A and 1B. Owing to this structure, the number of output signal lines to voltage reading section 25 becomes less than that of output signal lines outputting to respective recording heads 1A and 1B from waveform amplifying sections 24A and 24B, thus, reduction of a circuit size, namely, reduction of a base board and cost reduction become to be possible. In addition, voltages of drive signals to be applied on respective recording heads 1A and 1B are read out by a single and common voltage reading section 25, which results in no dispersion of reading accuracy and in accurate voltage correction.

If the selecting means 261 is constituted with a diode array, the scale of circuits can further be made smaller, and further cost reduction can be achieved, which is preferable.

Figure 21:
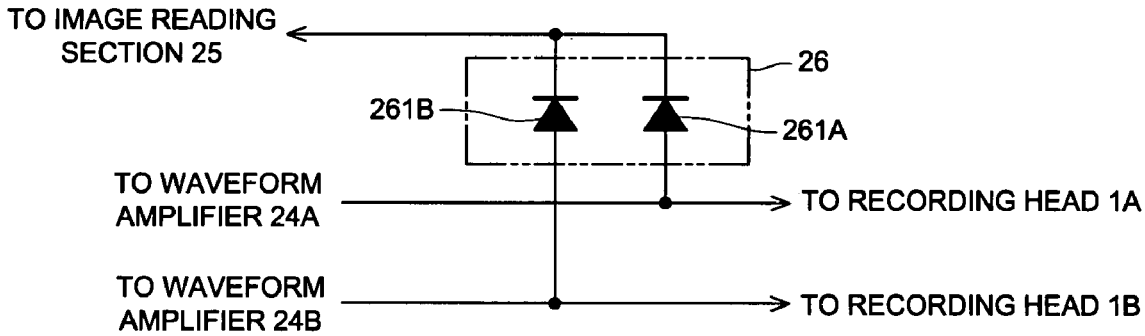
FIG. 21 is a drawing showing an example of the selector which selects the maximum voltage.

FIG. 21 shows an occasion where the selecting means 261 is constituted with a diode array connected on a wired OR basis. Owing to this, an anode of the diode array 261A on one side constituting the selecting means 261 is connected with an output signal line from waveform amplifying section 24A, and an anode of the diode array 261B on the other side is connected with an output signal line from waveform amplifying section 24B. Cathodes of respective diode arrays 261A and 261B are collected into a single output signal line and connected with voltage reading section 25.

In the selecting means 261 of this kind, voltage flowing through diode array 261A or 261B on one side does not flow in diode array 261B or 261A on the other side, and backflowing of voltage can be prevented accordingly. Therefore, the selecting means 261 has a function to protect recording heads which are not to be corrected in terms of voltage, and it serves also as a protective circuit.

Figure 22:
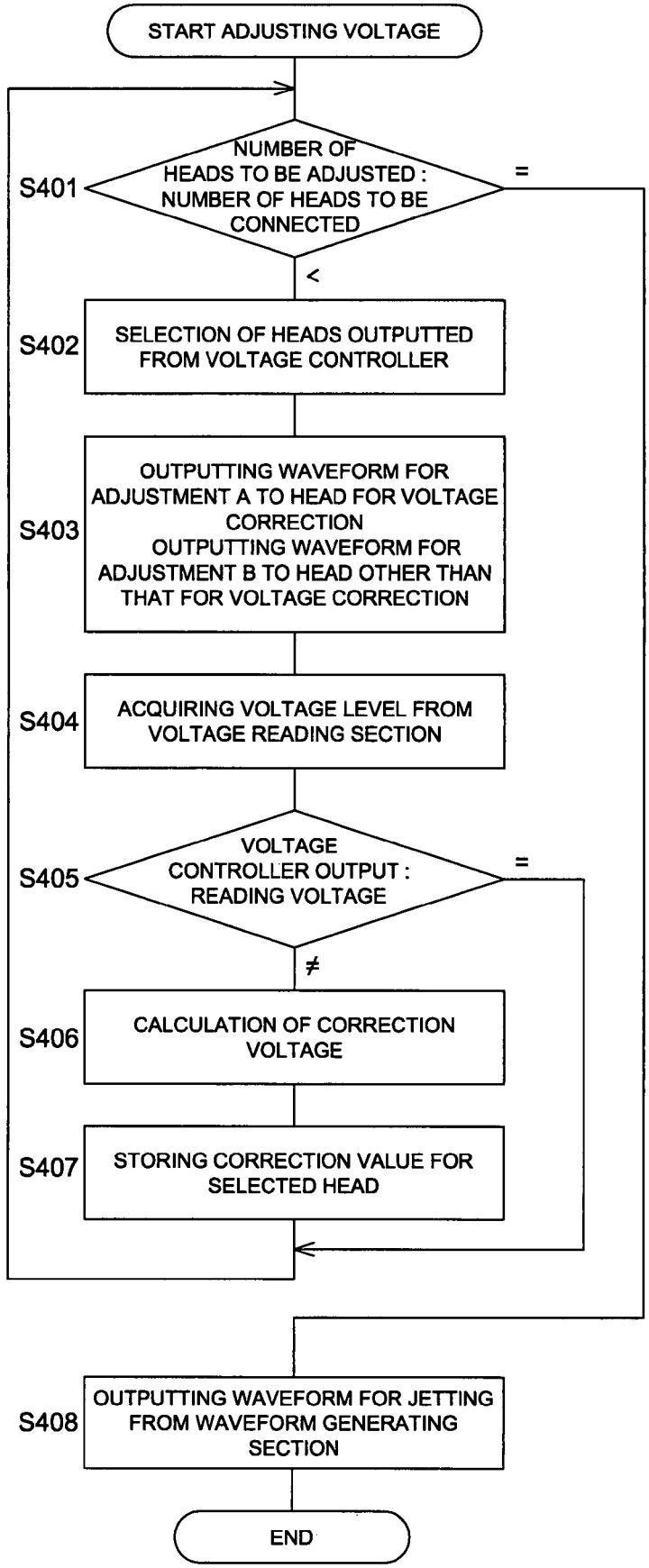
FIG. 22 is a flow chart showing an example of a voltage control method of the present invention.

Next, a voltage control method by the voltage control device 2 will be explained by the use of a flow chart shown in FIG. 22.

When voltage adjustment is required, voltage control section 21 confirms the number of heads connected to the number of adjustment heads subjected to voltage correction (S401). In this case, (the number of adjustment heads) is smaller than (the number of connection heads) because none of recording heads 1A and 1B is adjusted.

Then, the voltage control section 21 selects recording head to be corrected in terms of voltage (S402). The present explanation is given here under the assumption that recording head 1A is to be corrected in terms of voltage first. After the recording head is selected, the voltage control section 21 determines a prescribed voltage value and establishes it on each of voltage amplifying sections 22A and 22B. In this case, it is preferable to determine a value which makes voltage that is needed to jet ink droplets from recording heads 1A and 1B actually.

Then, the switching means 234 is controlled so that waveform for adjustment A shown in FIG. 4(*b*), for example, may be generated from waveform generating section 23 for recording head 1A to be corrected in terms of voltage, while, waveform for adjustment B shown in FIG. 4(*c*), for example, may be generated for recording head 1B which is not to be corrected in terms of voltage (S403). Owing to this, voltages outputted respectively from voltage amplifying sections 22A and 22B are combined respectively with waveform for adjustment A and waveform for adjustment B outputted from waveform generating section 23 in waveform amplifying sections 24A and 24B, and drive signals are generated to be outputted respectively to corresponding recording heads 1A and 1B.

Drive signals immediately after being outputted from waveform amplifying sections 24A and 24B are inputted respectively in selecting means 261. In this case, drive signals having prescribed voltage established in voltage control section 21 are inputted from waveform amplifying section 24A based on waveform for adjustment A, and drive signals having an amplitude value smaller than that of waveform amplifying section 24A are inputted from waveform amplifying section 24B based on waveform for adjustment B.

The selecting means 261 outputs only drive signals having the maximum voltage amount these drive signals to voltage reading section 25. Therefore, in this case, waveform for adjustment A is outputted to voltage reading section 25. In the voltage reading section 25, voltage of drive signal coming from waveform amplifying section 24A that is generated based on waveform for adjustment A is read and AD-converted, and its voltage value is outputted to voltage control section 21 (S404).

In this case, the voltage control section 21 compares a voltage value (output voltage) established on recording head 1A to be corrected in terms of voltage with a voltage value (input voltage) outputted from the voltage reading section 25 (S405).

When the output voltage is not equal to the input voltage after the comparison, the voltage control section 21 judges that the prescribed voltage determined in the aforesaid step S2 is not obtained for recording head 1A to be corrected in terms of voltage, and calculates the correction rate for achieving output voltage=input voltage, based on the difference between the output voltage and the input voltage (S406). A value of the correction rate thus calculated is stored in correction value storing means 211 as a correction value for recording head 1A (S407).

On the other hand, in the aforesaid step S405, when the output voltage is equal to the input voltage, the voltage control section 21 judges that prescribed voltage equal to that determined in the voltage control section 21 is obtained for recording head 1A to be corrected in terms of voltage, and voltage correction is not needed in particular, thus, voltage adjustment processing for recording head 1A is terminated.

After that, the flow returns to the aforesaid step S401, and processing beginning with the aforesaid step S402 is conducted for recording head 1B which is to be corrected in terms of voltage this time.

When voltage reading is completed for all recording heads 1A and 1B, namely, when (the number of adjustment heads) =(the number of connection heads) is achieved in the aforesaid step S401, the voltage control section 21 establishes a voltage value having a value obtained by multiplying a voltage value established by the outside by a correction value stored in correction value stored in correction value storing means 211, on a recording head that needs to be corrected in terms of voltage, and switching means 234 is switched and controlled so that a waveform for jetting may be outputted from waveform generating section 23, thus, drive signals having an intended accurate voltage are applied on all recording heads 1A and 1B (S408).

In the voltage control device and the voltage control method relating to the invention, drive signals based on waveform for adjustment A that is different from waveform for jetting are outputted to recording head 1A or 1B to be corrected in terms of voltage, as stated above, and its voltage is read out immediately after being outputted from waveform amplifying sections 24A and 24B, which makes it unnecessary to read voltage from drive signals which are based on a waveform for jetting having a complicated form of a waveform, thus, it becomes possible to measure voltage including an amount of amplification fluctuations in waveform amplifying sections 24A and 24B with a simple structure. Therefore, accurate control of voltage to be applied on recording heads 1A and 1B is made possible.

Further, since the waveform for adjustment B having an amplitude value smaller than that of waveform for adjustment A is outputted to recording head 1A or 1B which is not to be corrected in terms of voltage, it is not necessary to conduct voltage setting control that gives difference in height of voltage, between those to be corrected in terms of voltage and those which are not to be corrected in terms of voltage, in voltage control section 21. When establishing voltage by giving a difference in height by lowering compared with those to be corrected in terms of voltage like an occasion wherein 0 V is established for those which are not to be corrected in terms of voltage in the voltage control section 21, more time is needed for completion of voltage correction because a voltage drop requires more time in voltage amplifying sections 22A and 22B. However, in the invention, it is not necessary to establish different voltage values in voltage control section 21, and high speed voltage correction control can be realized, because waveform for adjustment B having an amplitude value smaller than that of waveform for adjustment A is outputted to those which are not to be corrected in terms of voltage, separately from waveform for adjustment A to be outputted for those to be corrected in terms of voltage.

Incidentally, although voltage control is conducted for each recording head in this case, it is also possible to conduct voltage control for each nozzle for plural nozzles of a recording head, in the case of a recording head on which the voltage can be controlled for each plural nozzles. In this case, voltage amplifying sections 22A, 22B, . . . and waveform amplifying section 24A, 24B, . . . are provided for each nozzle and output may be made for waveform amplifying sections 24A, 24B, . . . corresponding to each nozzle in the case of voltage correction, after switching to either one of waveform for adjustment A and waveform for adjustment B from waveform generating section 23.

A voltage control device and a liquid injection device of a liquid injection head relating to the invention can be applied to various fields employing a liquid injection head jetting a liquid by changing voltage and thereby making a liquid to be a liquid-drop, such as an electrode forming device that forms an electrode by jetting a liquid-type electrode material on a base board, a biochip manufacturing apparatus that manufactures biochip by jetting an organism sample, a micro-pipette that jets a prescribe amount of materials, and a coating device that coats adhesives on an intended area of a material to be subjected to coating by making the adhesives to be a liquid-drop, in addition to those applied to the image recording apparatus explained above.

What is claimed is:

1. A voltage control device for a liquid injection head comprising:

a waveform generator for setting a drive waveform to be applied to the liquid injection head that injects a liquid from a nozzle by changing a drive voltage, wherein the waveform generator includes a first drive waveform generator that outputs a first drive waveform for liquid injection, and a second drive waveform generator that outputs a second drive waveform for voltage correction;

a selector that selects a drive waveform from the waveform generator to either one of the first drive waveform and the second drive waveform;

a voltage determining device that determines a voltage of the drive waveform set by the waveform generator;

a voltage amplifier that boosts a voltage to be applied to the liquid injection head so as to be the voltage determined by the voltage determining device;

a waveform amplifier that amplifies the drive waveform set by the waveform generator so that the voltage of the drive waveform is the voltage boosted by the voltage amplifier;

a voltage reader that reads a voltage of the second drive waveform amplified by the waveform amplifier, and a voltage adjuster that compares the voltage of the second drive waveform read by the voltage reader with voltage determined by the voltage determining device, calculates a correction value from a result of the comparison, adds a correction to the voltage determined by the voltage determining device based on the correction value.

2. A voltage control device for liquid injection heads comprising:

a waveform generator for setting a drive waveform to be applied, by changing a drive voltage, on the liquid injection heads for injecting liquid or on the nozzles included in the head for injecting liquid, wherein the waveform generator includes a first drive waveform generator that outputs a first drive waveform for liquid injection, and a second drive waveform generator that outputs a second drive waveform for a voltage correction;

a first selector that selects a drive waveform from the waveform generator to either one of the first drive waveform and the second drive waveform;

a voltage determining device that determines a voltage of the drive waveform set by the waveform generator;

a plurality of voltage amplifiers for boosting a voltage to be applied to the liquid injection heads or on the nozzles so as to be the voltage determined by the voltage determining device;

a plurality of drive waveform amplifiers for amplifying each of the drive waveforms set by the waveform generator so that the voltage of the drive waveform is the voltage boosted by the voltage amplifier;

a second selector for selecting a voltage of a second drive waveform to be corrected from a plurality of voltages of each of the drive waveforms amplified by the drive waveform amplifier;

a voltage reader that reads the voltage selected by the second selector; and a voltage adjuster that compares the voltage of the second drive waveform read by the voltage reader with voltage determined by the voltage determining device, calculates a correction value from a result of the comparisons and adds a correction to the voltage determined by the voltage determining device based on the correction value.

3. The voltage control device of claim 2, wherein the second selector selects the maximum voltage from the plurality of voltages of each of the drive waveforms amplified by the drive waveform amplifier, and the voltage determining device determines voltage so that the voltage of the drive waveform to be corrected is the maximum voltage in the plurality of voltages of each of the drive waveforms amplified by the drive waveform amplifier.

4. The voltage control device of claim 3, wherein the second selector includes: a plurality of signal wires which read voltages amplified by the waveform amplifier, are connected through wired OR connection, and are outputted to the voltage reader by a single signal wire.

5. The voltage control device of claim 3, wherein the second selector is composed of a diode array.

6. The voltage control device of claim 2, wherein the second drive waveform is a direct current waveform.

7. The voltage control device of claim 2, further comprising:

a reference voltage generator for generating a reference voltage, wherein the voltage adjuster compares the voltage selected by the second selector with the reference voltage generated by the reference voltage generator.

8. The voltage control device of claim 2, further comprising:

a voltage divider for dividing voltage of the waveform outputted from the second selector and inputting the divided voltage to the voltage adjustor.

9. The voltage control device of claim 2, wherein the waveform generator further comprises a third drive waveform generator for generating a third drive waveform having an amplitude value smaller than that of the second drive waveform, and the first selector selects the third drive waveform as a drive voltage applied on the liquid injection head to be corrected or nozzle to be corrected.

10. A voltage control method for a liquid injection head comprising the steps of:

a waveform generating step for setting a drive waveform including a first drive waveform for liquid injection and a second drive waveform for a voltage correction to be applied to the liquid injection head that injects a liquid from a nozzle by changing a drive voltage;

a selecting step for switching the drive waveform to either one of the first drive waveform and the second drive waveform;

a voltage determining step for determining a voltage of the drive waveform set by the waveform generating step;

a voltage amplifying step for boosting a voltage to be applied to the liquid injection head so as to be the voltage determined by the voltage determining step;

a waveform amplifying step for amplifying the drive waveform set by the waveform generating step so that the voltage of the drive waveform is the voltage boosted by the voltage amplifying step;

a voltage reading step for reading the voltage of the drive waveform amplified by the waveform amplifying step; and a voltage adjusting step for comparing the voltage of the first waveform read by the voltage reading step with voltage determined by the voltage determining step, calculating a correction value from a result of the comparison, and adding a correction to the voltage determined by the voltage determining step based on the correction value.

11. A voltage control method for liquid injection heads comprising the steps of:

a waveform generating step for setting drive waveforms including a first drive waveform for liquid injection and a second drive waveform for a voltage correction to be applied, by changing a drive voltage, to the liquid injection heads for injecting liquid or on the nozzles included in the head for injecting liquid;

a first selecting step for selecting a drive waveform from the waveform generator to either one of the first drive waveform and the second drive waveform;

a voltage determining step for determining a voltage of the drive waveform set by the waveform generating step;

a voltage amplifying step for boosting a voltage to be applied to the liquid injection heads or on the nozzles so as to be the voltage determined by the voltage determining step;

a drive waveform amplifying step for amplifying each of the drive waveforms set by the waveform generating step so that the voltage of the drive waveform is the voltage boosted by the voltage amplifying step;

a second selecting step for selecting a voltage of the second drive waveform to be corrected from a plurality of voltages of each of the drive waveforms amplified by the drive waveform amplifying step;

a voltage reading step for reading the voltage selected by the second selecting step; and a voltage adjusting step for comparing the voltage of the first waveform read by the voltage reading step with voltage determined by the voltage determining step, calculating a correction value from a result of the comparison, and adding a correction to the voltage determined by the voltage determining step based on the correction value.

12. The voltage control method of claim 11, wherein the second selecting step selects the maximum voltage from the plurality of voltages of each of the drive waveforms amplified by the drive waveform amplifying step, and the voltage determining step determines voltage so that the voltage of the drive waveform to be corrected is the maximum voltage in the plurality of voltages of each of the drive waveforms amplified by the drive waveform amplifying step.

13. The voltage control method of claim 11, further comprising the step of:

a reference voltage generating step for generating a reference voltage, wherein the voltage adjusting step compares the voltage of the second waveform selected by the second selecting step with the reference voltage generated by the reference voltage generating step.

14. The voltage control method of claim 11, further comprising the steps of:

a voltage dividing step for dividing voltage of the waveform selected by the second selecting step, and a inputting step for inputting the divided voltage for the voltage adjusting step.

15. The voltage control device of claim 11, wherein the waveform generated by the waveform generating step including a third drive waveform having an amplitude value smaller than that of the second drive waveform, and the first selecting step selects the third drive waveform as a drive voltage applied to the liquid injection head to be corrected or nozzle to be corrected.

16. A liquid injection device comprising:

a plurality of liquid injection heads including nozzles for injecting liquid;

a waveform generator for setting a drive waveform to be applied, by changing a drive voltage, to the liquid injection heads or on the nozzles for injecting liquid, wherein the waveform generator includes a first drive waveform generator that outputs a first drive waveform for the liquid injection and a second drive waveform generator that outputs a second drive waveform for the voltage correction;

a first selector that selects a drive waveform from the waveform generator to either one of the first drive waveform and the second drive waveform;

a voltage determining device that determines a voltage of the drive waveform set by the waveform generator;

a plurality of voltage amplifiers for boosting a voltage to be applied to the liquid injection heads or on the nozzles so as to be the voltage determined by the voltage determining device;

a plurality of drive waveform amplifiers for amplifying each of the drive waveforms set by the waveform generator so that the voltage of the drive waveform is the voltage boosted by the voltage amplifier;

a second selector for selecting a voltage of the second drive waveform to be corrected from a plurality of voltages of each of the drive waveforms amplified by the drive waveform amplifier;

a voltage reader that reads the voltage selected by the second selector, and a voltage adjuster that compares the voltage of the second waveform read by the voltage reader with voltage determined by the voltage determining device, calculates a correction value from a result of the comparison, and adds a correction to the voltage determined by the voltage determining device based on the correction value.

* * * * *